US006892859B2

(12) United States Patent
van der Pol

(10) Patent No.: US 6,892,859 B2
(45) Date of Patent: May 17, 2005

(54) SELF-STABILIZING TRESTLE

(76) Inventor: Paul van der Pol, 11414 Whitney Hill Rd., Louisville, KY (US) 40299

( * ) Notice: Subject to any disclaimer, the term of this patent is extended or adjusted under 35 U.S.C. 154(b) by 30 days.

(21) Appl. No.: 10/431,789

(22) Filed: May 8, 2003

(65) Prior Publication Data

US 2004/0222042 A1 Nov. 11, 2004

(51) Int. Cl.[7] ..... E04G 1/34; E04G 1/32
(52) U.S. Cl. ..... 182/153; 182/225
(58) Field of Search ..... 182/151, 153, 182/155, 224, 225, 181.1, 182.4, 186.1, 186.2, 186.3, 186.5; D25/67

(56) References Cited

U.S. PATENT DOCUMENTS

| | | | | |
|---|---|---|---|---|
| 1,680,065 | A | | 8/1928 | Proctor |
| 2,436,337 | A | * | 2/1948 | Smith et al. ..... 182/186.3 |
| 2,876,046 | A | * | 3/1959 | Owen ..... 182/225 |
| 3,045,777 | A | * | 7/1962 | Dintelmann ..... 182/153 |
| 3,078,957 | A | | 2/1963 | Larson |
| 3,204,906 | A | | 9/1965 | Henderson |
| 3,848,701 | A | | 11/1974 | Hughes |
| 3,978,943 | A | | 9/1976 | Greenman et al. |
| 4,009,855 | A | | 3/1977 | Hoffmann et al. |
| 4,135,691 | A | | 1/1979 | Wiesmann |
| 4,238,001 | A | | 12/1980 | Alexander |
| 4,241,808 | A | | 12/1980 | Middleton et al. |
| 4,278,148 | A | | 7/1981 | Daley et al. |
| 4,298,094 | A | | 11/1981 | Strong |
| 4,298,096 | A | | 11/1981 | Prior |
| 4,325,463 | A | | 4/1982 | Taylor |
| 4,502,563 | A | | 3/1985 | Pershon |
| 4,515,243 | A | | 5/1985 | Prior |
| D280,440 | S | | 9/1985 | Gromer, Jr. |
| D280,558 | S | | 9/1985 | Lazar et al. |
| 4,566,559 | A | | 1/1986 | van Asten |
| D286,573 | S | | 11/1986 | Kilenstam |
| 4,620,613 | A | | 11/1986 | Albertson |
| 4,681,187 | A | * | 7/1987 | Brown ..... 182/129 |
| 4,730,698 | A | | 3/1988 | Harris |
| 4,733,704 | A | | 3/1988 | Wolff |
| 4,763,757 | A | * | 8/1988 | Cheney ..... 182/21 |
| 4,938,311 | A | * | 7/1990 | Combs ..... 182/155 |
| 5,007,502 | A | | 4/1991 | Shaprio |
| 5,020,634 | A | | 6/1991 | Gunderson et al. |
| 5,096,019 | A | | 3/1992 | Kelsay |
| 5,141,077 | A | | 8/1992 | Zuercher |
| 5,207,290 | A | | 5/1993 | Torok |
| 5,215,162 | A | | 6/1993 | Parks et al. |
| 5,351,785 | A | | 10/1994 | DuRapau |
| 5,365,697 | A | | 11/1994 | Vanderpan |
| 5,404,962 | A | | 4/1995 | Carter |
| 5,439,073 | A | | 8/1995 | Johnson |
| 5,499,585 | A | | 3/1996 | Vanderminden, Sr. |
| D370,271 | S | | 5/1996 | Smith |
| 5,560,449 | A | | 10/1996 | Smith |
| 5,582,267 | A | * | 12/1996 | Bockoven et al. ..... 182/153 |
| D378,544 | S | | 3/1997 | Aldredge |
| D379,236 | S | | 5/1997 | Sheftel |
| 5,626,205 | A | | 5/1997 | Martin |
| 5,626,321 | A | | 5/1997 | Ulshafer, Jr. |
| 5,647,455 | A | | 7/1997 | Russell |
| RE35,627 | E | | 10/1997 | Estrem |
| 5,690,303 | A | | 11/1997 | Winters |
| 5,720,362 | A | | 2/1998 | Denkins |
| D392,746 | S | | 3/1998 | Dickinson et al. |
| 5,758,744 | A | | 6/1998 | Forino |
| 5,779,003 | A | | 7/1998 | Carty |
| 5,865,269 | A | | 2/1999 | Eskesen |
| 6,129,180 | A | * | 10/2000 | Brady ..... 182/186.4 |
| 6,283,250 | B1 | | 9/2001 | Asher |

* cited by examiner

*Primary Examiner*—Hugh B. Thompson, II
(74) *Attorney, Agent, or Firm*—Stites & Harbison, PLLC; David W. Nagle, Jr.

(57) ABSTRACT

A self-stabilizing trestle includes independently pivoting leg assemblies, which allow a substantially horizontal support surface defined by the trestle to be maintained stable when the trestle is placed on uneven terrain.

23 Claims, 22 Drawing Sheets

SELF-STABILIZING TRESTLE

BACKGROUND OF THE INVENTION

The present invention relates to support structures, and, more particularly, to a self-stabilizing trestle that can be used as a sawhorse, scaffolding base, or similar support. Such support structures are generally comprised of a crossbeam that defines a substantially horizontal support surface that is supported by a pair of leg assemblies or legs. In their simplest form, the legs of these support structures are rigidly secured to the crossbeam, thereby preventing any movement of the legs relative to the crossbeam. Rigid attachment of the legs to the crossbeam, however, can be antithetical to the objective of providing a stable support base, as the support structure can not always be positioned on even terrain. Specifically, if one of the legs of such a support structure is not firmly resting on the underlying terrain, the structure may wobble and/or sway. Furthermore, if the support structure is used to support a board or other item for sawing, the reciprocating motion induced by sawing may cause the support structure to walk, creating unsafe conditions and discomfort for the user, and making it difficult to use a saw or similar tool with a high degree of precision. Finally, if one of the legs is not firmly resting upon the underlying terrain, structural integrity may be compromised.

Although rigid attachment of the legs to the crossbeam is still common, there are sawhorses and similar support structures in the prior art that provide for some pivotable attachment of the legs to the crossbeam. For example:

U.S. Pat. No. 1,680,065 (issued to Proctor) discloses a foldable support in which legs are attached to an upper body through pivot pins. However, the legs pivot independently for the sole purpose of making the platform smaller during transportation and storage.

U.S. Pat. No. 3,078,957 (issued to Larson) discloses a collapsible sawhorse bracket assembly, which includes a pivot pin that creates a clamping leverage. However, once the legs are in the operative position, the legs no longer pivot relative to the crosspiece. Therefore, this sawhorse is not self-stabilizing.

U.S. Pat. No. 5,207,290 (issued to Torok) discloses a hinge for a folding sawhorse. However, the leg assemblies pivot independently for the sole purpose of making the sawhorse smaller during transportation and storage.

U.S. Pat. No. 5,626,205 (issued to Martin) also discloses pivoting legs attached to a portable work platform. Again, however, the legs pivot independently for the sole purpose of making the platform smaller during transportation and storage.

Although the above prior art references teach various means by which to pivot or fold the legs of a sawhorse or similar support structure for transportation, storage, or similar purposes, none of these references addresses the objective of providing a stable support base on uneven terrain. Nevertheless, in the prior art, there have also been some attempts to provide a means by which to level or otherwise adapt a sawhorse or similar support structure for placement on uneven terrain. For example:

U.S. Pat. No. 5,007,502 (issued to Shapiro) discloses a self-leveling sawhorse. The legs are connected to the traverse cross bar through rods that are in a lateral, perpendicular orientation to the cross bar. The self-leveling properties of this sawhorse are derived from sliding the leg assemblies in a lateral direction. However, a disadvantage of such a design is that the cross bar does not have good rotational stability.

U.S. Pat. No. 3,204,906 (issued to Henderson) discloses a stabilized four-legged table, which has two legs rigidly attached to the table top, and an assembly with two legs that are pivotally attached to the table top. Although this table has four feet, the stabilizing properties are geometrically no different than a table top with three feet.

U.S. Pat. No. 5,660,303 (issued to Winters) discloses a self-stabilizing base for a table that includes a means for rotatably attaching one leg assembly to a central support while a second leg assembly is rigidly attached to the central support. Although this table base has four feet, the stabilizing properties are geometrically no different than a base with three feet. Winters recognizes this deficiency by stating that the central support will wobble rather than the legs. To prevent wobbling of the central support, Winters introduces friction in the pivoting attachment. Although sufficient friction will eliminate wobbling of the central support, in effect it also eliminates self-stabilization of the feet.

U.S. Pat. No. 5,865,269 (issued to Eskesen) discloses a work support that allows for both height adjustment and leveling. Specifically, leveling and stabilization is accomplished by manually adjusting the length of at least one leg. Although this concept provides for stabilizing the workbench on uneven terrain, the stabilization is not automatic and may need to be redone each time the workbench is moved to another location.

U.S. Pat. No. 6,283,250 (issued to Asher) discloses a portable and adjustable workbench in which the legs can be adjusted in length. The work support is stabilized by manually adjusting the length of at least one leg. Although this concept provides for stabilizing the workbench on uneven terrain, the stabilization is not automatic and may need to be redone when the workbench is moved to another location.

Finally, Applicant is aware of various commercially available sawhorses that can be considered to be "self-stabilizing" because of the torsional flexibility of the crossbeam. Such a design, however, results in a sawhorse with limited load bearing capacity as torsional flexibility is essentially a deformation caused by a lack of strength.

Although the above prior art references discuss the problem of placement of a sawhorse or similar support structure on uneven terrain, these references either do not provide for "automatic" leveling (i.e., require some manual adjustment), or have limited strength because adjustment or leveling is based on the distortion of deformation of structural components of the sawhorse or support structure.

It is therefore a paramount object of the present invention to provide a self-stabilizing support structure, a trestle, that automatically adjusts for placement on uneven terrain, thereby maintaining the stability of the trestle without sacrificing the strength or structural integrity of the trestle.

This and other objects and advantages of the present invention will become apparent upon a reading of the following description along with the appended drawings.

SUMMARY OF THE INVENTION

The present invention is a self-stabilizing trestle that includes independently pivoting leg assemblies, which allow a substantially horizontal support surface defined by the trestle to be maintained stable when the trestle is placed on uneven terrain.

A preferred self-stabilizing trestle is generally comprised of a substantially horizontal crossbeam that is supported by first and second leg assemblies. The first leg assembly is pivotally secured to the crossbeam along a first side edge, and the second leg assembly is pivotally secured to the crossbeam along a second side edge. Each leg assembly has a generally tetrahedral structure and is supported by a pair of feet that contact the underlying terrain.

A first hinge operably and pivotally connects the first leg assembly to the crossbeam. This first hinge defines an axis of rotation that is oriented at a predetermined acute angle relative to the support surface defined by the crossbeam. Similarly, a second hinge operably and pivotally connects the second leg assembly to the crossbeam. This second hinge defines an axis of rotation that is also oriented at a predetermined acute angle relative to the support surface defined by the crossbeam. Geometrically, the two rotation axes are preferably substantiality coplanar, but not coaxial. The two rotation axes intersect one another either below or above the crossbeam.

As mentioned above, the leg assemblies of a preferred self-stabilizing trestle each have a pair of divergent feet, which are the components of the leg assemblies that actually contact the underlying terrain. The front and rear feet of each leg assembly are spaced apart from one another on opposite sides of the crossbeam. In operation, the self-stabilizing characteristics of a trestle made in accordance with the present invention are dependent on the ability of these feet to slip relative the underlying terrain. The slippage of each foot can be quantified in terms of a "slippage ratio," which is the amount of horizontal travel of a foot in the x-direction divided by the amount of vertical travel in the y-direction of that same foot as a leg assembly rotates. More importantly, for purposes of the present discussion, the slippage ratio can be mathematically correlated to the axis orientation angle, the angle at which the axis of rotation of a leg assembly is oriented with respect to the crossbeam.

A trestle constructed in this manner and with appropriately selected axis orientation angles will automatically adjust for placement on uneven terrain, thereby maintaining the stability of the trestle without sacrificing the strength or structural integrity of the trestle. This self-stabilization does not require manual intervention or any form of adjustment. Furthermore, this self-stabilization is not dependent on the distortion or deformation of any of its structural components.

DETAILED DESCRIPTION OF THE INVENTION

The present invention is a self-stabilizing trestle that includes independently pivoting leg assemblies, which allow a substantially horizontal support surface defined by the trestle to be maintained stable when the trestle is placed on uneven terrain.

Figure 1:
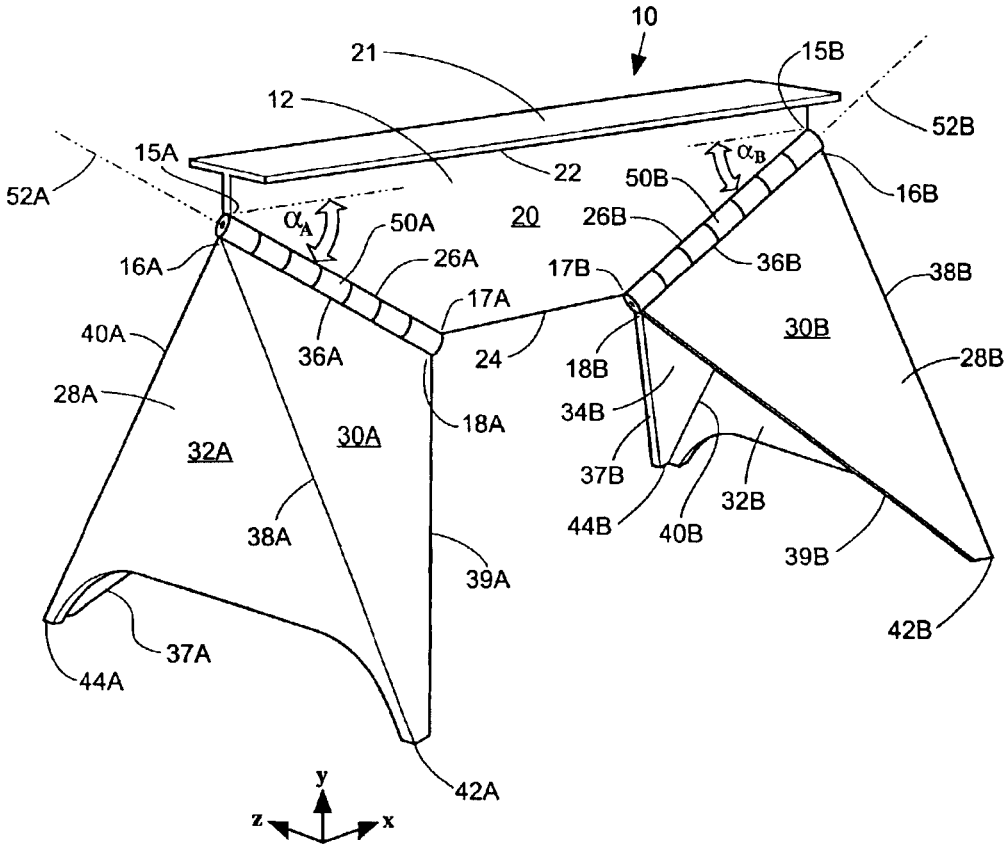
FIG. 1 is a perspective view of a preferred self-stabilizing trestle made in accordance with the present invention.
Figure 2:
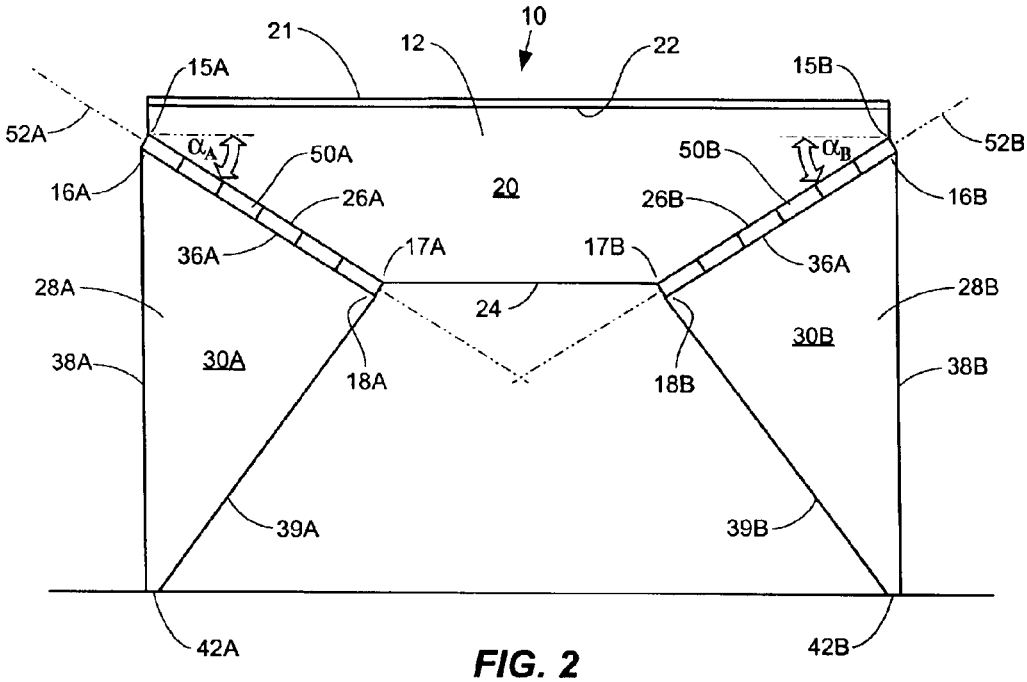
FIG. 2 is a side view of the self-stabilizing trestle of FIG. 1.
Figure 3:
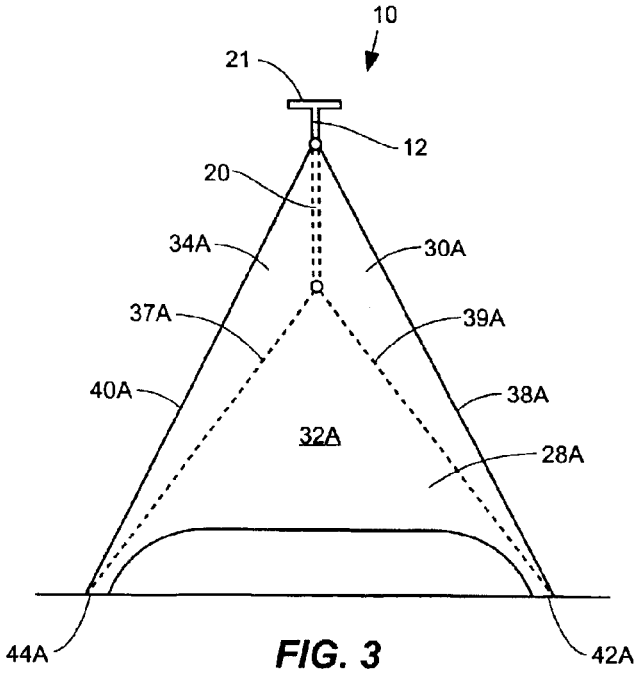
FIG. 3 is an end view of the self-stabilizing trestle of FIG. 1.

FIGS. 1–3 show a first preferred embodiment of a self-stabilizing trestle 10 made in accordance with the present invention. The trestle 10 is generally comprised of a substantially horizontal crossbeam 12 that is supported by first and second leg assemblies 28A, 28B. The crossbeam 12 has an upper flange 21 that defines a substantially horizontal support surface, and a web portion 20 that is perpendicularly secured to the upper flange 21. As best shown in FIGS. 1 and 2, the web portion 20 of the crossbeam 12 is preferably a substantially trapezoidal plate that has parallel upper and lower base edges 22, 24 and first and second side edges 26A, 26B. The upper flange 21 is secured to the web portion 20 along the upper base edge 22 of the trapezoidal plate.

The first leg assembly 28A is pivotally secured to the crossbeam 12 along the first side edge 26A of the web portion 20, between the endpoints 15A, 17A of the side edge 26A, as will be further described below. Similarly, the second leg assembly 28B is pivotally secured to the crossbeam 12 along the second side edge 26B of the web portion 20, between the endpoints 15B, 17B of the side edge 26B, as will be further described below.

In this preferred embodiment, the first leg assembly 28A has a generally tetrahedral structure comprised of three triangular lateral faces 30A, 32A, 34A joined along three lateral edges 36A, 38A, 40A. Similarly, the second leg assembly 28B also has a generally tetrahedral structure comprised of three triangular lateral faces 30B, 32B, 34B joined along three lateral edges 36B, 38B, 40B.

The intersection of the lateral edges 36A, 38A, 40A of the first leg assembly 28A defines an outer vertex 16A near the top of the tetrahedral structure. The intersection of the lateral edges 36A, 37A, 39A of leg assembly 28A defines a second, inner vertex 18A near the top of the tetrahedral structure. Similarly, the intersection of the lateral edges 36B, 38B, 40B of the second leg assembly 28B defines an outer vertex 16B near the top of the tetrahedral structure, and the intersection of the lateral edges 36B, 37B, 39B of the second leg assembly 28B defines an inner vertex 18B near the top of the tetrahedral structure.

A first hinge 50A is secured between lateral edge 36A of the first leg assembly 28A and the first side edge 26A of the web portion 20, operably and pivotally connecting the first leg assembly 28A to the web portion 20 of the crossbeam 12. The first hinge 50A defines an axis of rotation 52A that is oriented at a predetermined acute angle $\alpha_A$ relative to the support surface defined by the crossbeam 12. The importance of selecting an appropriate orientation angle $\alpha_A$ for this rotation axis 52A will be described in further detail below.

Similarly, a second hinge 50B is secured between the lateral edge 36B of the second leg assembly 28B and the second side edge 26B of the web portion 20, operably and pivotally connecting the second leg assembly 28B to the web portion 20 of the crossbeam 12. The second hinge 50B defines an axis of rotation 52B that is also oriented at a predetermined acute angle $\alpha_B$ relative to the support surface defined by the crossbeam 12.

Geometrically, the two rotation axes 52A, 52B are preferably substantiality coplanar, but not coaxial. The two rotation axes 52A, 52B intersect one another below the flange 21 of crossbeam 12. In addition, the longitudinal axis of the crossbeam 12 (defined by the upper base edge 22 of the web portion) and the two rotation axes 52A, 52B are essentially coplanar and effectively define a triangle, pointing downward. In other words, the web portion 20 of the crossbeam can be visualized as part of a plane that essentially bisects the trestle 10, said first and second rotation axes 52A, 52B lying within this plane.

As a further refinement, the leg assemblies 28A, 28B of the preferred trestle 10 shown in FIGS. 1–3 each have a pair of divergent feet 42A, 44A, 42B, 44B. These feet 42A, 44A, 42B, 44B are the components of the leg assemblies 28A, 28B that actually contact the underlying terrain. In this regard, the front foot 42A of the first leg assembly 28A lies substantially at the intersection of edges 38A and 39A, and the rear foot 44A of the first leg assembly 28A lies substantially at the intersection of edges 37A and 40A. Similarly, the front foot 42B of the second leg assembly 28B lies substantially at the intersection of edges 38B and 39B, and the rear foot 44B of the second leg assembly 28B lies substantially at the intersection of edges 37B and 40B. In other words, the front and rear feet 42, 44 of each leg assembly 28 are spaced apart from one another across the bisecting plane defined by the web portion 20 of crossbeam 12.

Figure 4:
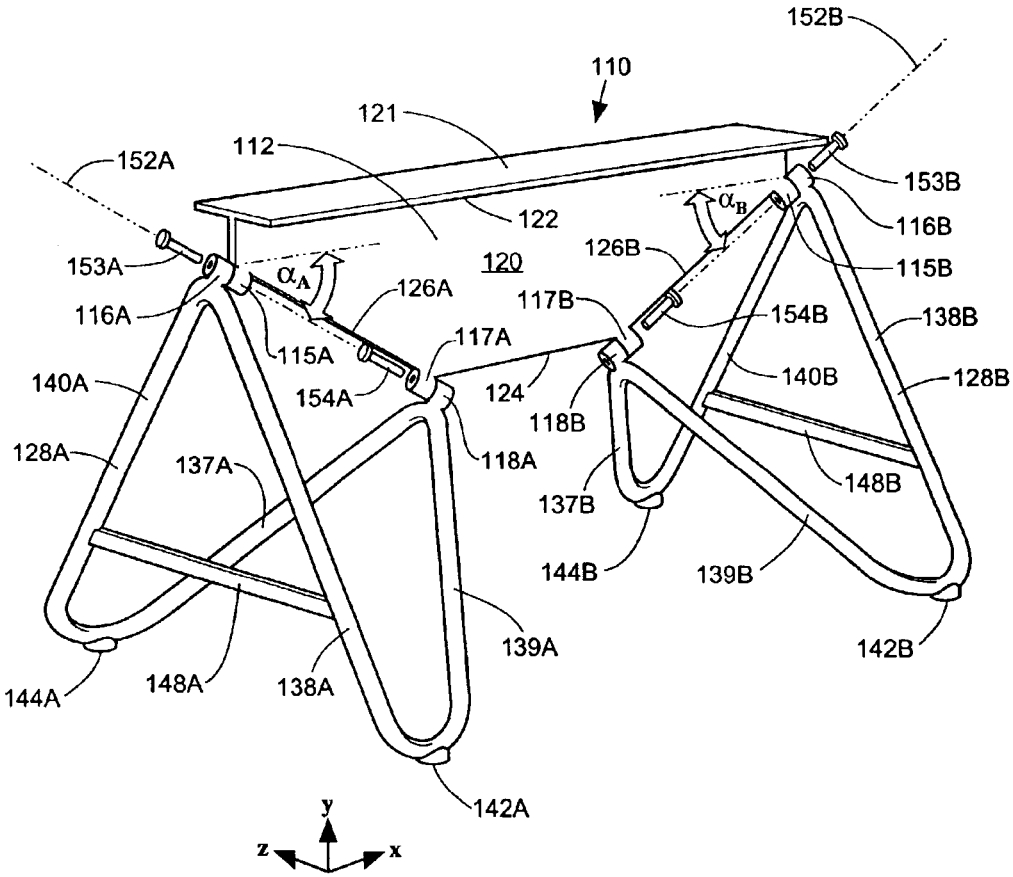
FIG. 4 is a perspective view of an alternate preferred embodiment of a self-stabilizing trestle made in accordance with the present invention.
Figure 5:
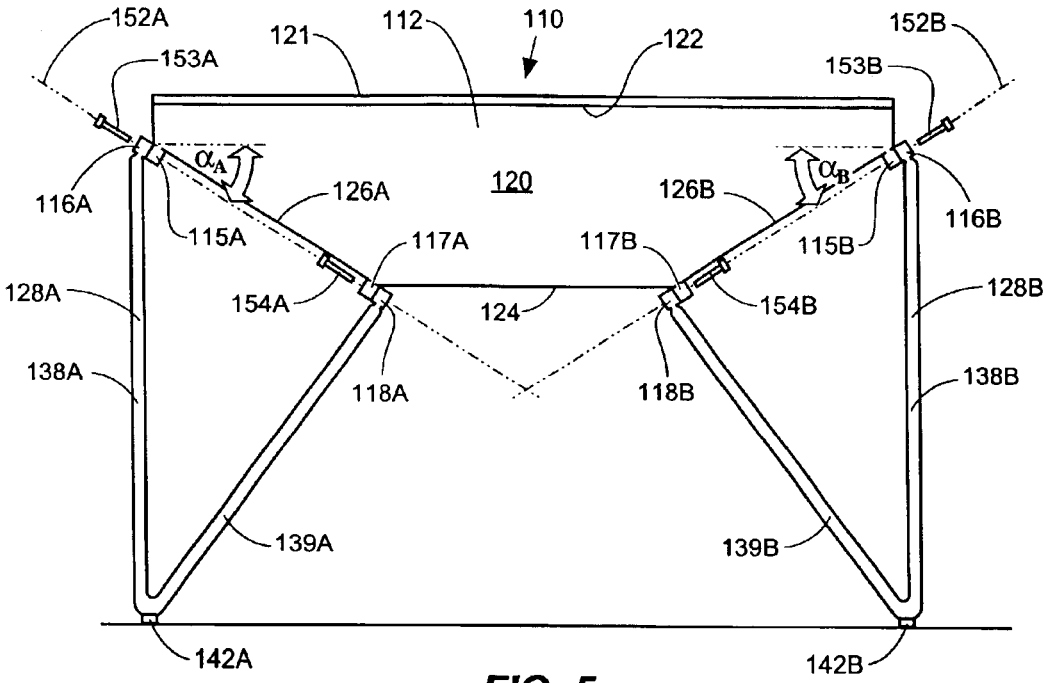
FIG. 5 is a side view of the self-stabilizing trestle of FIG. 4.
Figure 6:
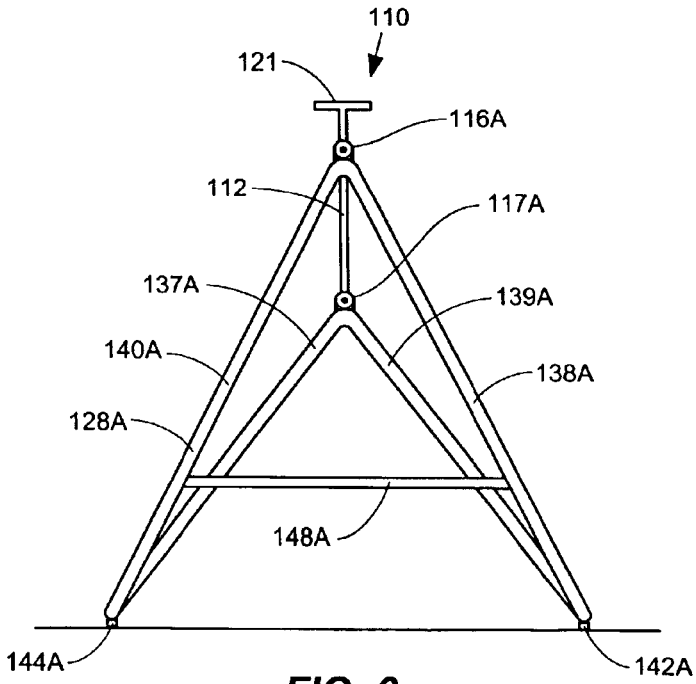
FIG. 6 is an end view of the self-stabilizing trestle of FIG. 4.

Before discussing the operation of the self-stabilizing trestle 10 of the present invention in detail and the advantages it provides, it is instructive to examine an alternate preferred embodiment of the self-stabilizing trestle 110 of the present invention, as shown in FIGS. 4–6.

Whereas the first preferred embodiment of the trestle 10 as described with reference to FIGS. 1–3 has leg assemblies 28A, 28B comprised of adjacent lateral faces, the leg assemblies 128A, 128B of the second preferred embodiment, trestle 110, shown in FIGS. 4–6 are formed from tubular members that create the desired tetrahedral structure.

Again, the trestle 110 is generally comprised of a substantially horizontal crossbeam 112 that is supported by first and second leg assemblies 128A, 128B. The crossbeam 112 has an upper flange 121 that defines a substantially horizontal support surface, and a web portion 120 that is perpendicularly secured to the upper flange 121. As best shown in FIGS. 4 and 5, the web portion 120 of the crossbeam 112 is preferably a substantially trapezoidal plate that has parallel upper and lower base edges 122, 124 and first and second side edges 126A, 126B. The upper flange 121 is secured to the web portion 120 along the upper base edge 122 of the trapezoidal plate. The leg assemblies 128A, 128B are pivotally secured to crossbeam 112 along the first and second side edges 126A, 126B of the web portion 120, as will be further described below.

In this preferred embodiment, the first leg assembly 128A has a generally tetrahedral structure formed from four tubular leg members 137A, 138A, 139A, 140A. Similarly, the second leg assembly 128B has a generally tetrahedral structure formed from four tubular leg members 137B, 138B, 139B, 140B.

Integral with and extending from the distal endpoints of the first side edge 126A is a pair of hinge knuckles 115A, 117A. Similarly, there is a corresponding pair of hinge knuckles 116A, 118A extending from the leg assembly 128A. In this preferred embodiment, and as shown in FIGS. 4 and 5, the first leg assembly 128A is thus operably and pivotally connected to the crossbeam 112 by passing a first hinge pin 153A through the upper hinge knuckles 115A, 116A and passing a second hinge pin 154A through the lower hinge knuckles 117A, 118A. The hinge pins 153A, 154A that connect the first leg assembly 128A to the crossbeam 112 define a common axis of rotation 152A that, similar to the embodiment illustrated in FIGS. 1–3, is oriented at a predetermined acute angle $\alpha_A$ relative to the support surface defined by the crossbeam 112. The importance of selecting an appropriate orientation angle $\alpha_A$ for this rotation axis 152A will be described in further detail below.

Similarly, integral with and extending from the distal endpoints of the second side edge 126B is a pair of hinge knuckles 115B, 117B. There is also a corresponding pair of hinge knuckles 116B, 118B extending from the leg assembly 128B. In this preferred embodiment, and as shown in FIGS. 4 and 5, the second leg assembly 128B is thus operably and pivotally connected to the crossbeam 112 by passing a first hinge pin 153B through the upper hinge knuckles 115B, 116B and passing a second hinge pin 154B through the lower hinge knuckles 117B, 118B. The hinge pins 153B, 154B that connect the second leg assembly 128B to the crossbeam 112 define a common axis of rotation 152B that, similar to the embodiment illustrated in FIGS. 1–3, is oriented at a predetermined acute angle $\alpha_B$ relative to the support surface defined by the crossbeam 112. The importance of selecting an appropriate orientation angle $\alpha_B$ for this rotation axis 152B will be described in further detail below.

As with the embodiment illustrated in FIGS. 1–3, the two rotation axes 152A, 152B are preferably substantiality coplanar, but not coaxial. The two rotation axes 152A, 152B intersect one another below the flange 121 of crossbeam 112. In addition, the longitudinal axis of the crossbeam 112 (upper base edge 122 of the web portion) and the two rotation axes 152A, 152B are essentially coplanar and effectively define a triangle, pointing downward. In other words, the web portion 120 of the crossbeam can be visualized as part of a plane that essentially bisects the trestle 110, said first and second rotation axes 152A, 152B lying within this plane.

As a further refinement, the leg assemblies 128A, 128B of the preferred trestle 110 shown in FIGS. 4–6 each have a pair of divergent feet 142A, 144A, 142B, 144B. These feet 142A, 144A, 142B, 144B are the components of the leg assemblies 128A, 128B that actually contact the underlying terrain. In this regard, the front foot 142A of the first leg assembly 128A lies substantially at the intersection of leg members 138A and 139A, and the rear foot 144A of the first leg assembly 128A lies substantially at the intersection of leg members 137A and 140A. Similarly, the front foot 142B of the second leg assembly 128B lies substantially at the intersection of leg members 138B and 139B, and the rear foot 144B of the second leg assembly 128B lies substantially at the intersection of leg members 137B and 140B. In other words, the front and rear feet 142, 144 of each leg assembly 128 are spaced apart from one another across the bisecting plane defined by the web portion 120 of crossbeam 112.

In this particular embodiment, to ensure that a fixed distance is maintained between the feet 142A, 144A of the first leg assembly 128A, a spreader brace 148A is secured to and extends between leg members 138A, 140A of the leg assembly 128A. Similarly, to ensure that a fixed distance is maintained between the feet 142B, 144B of the second leg assembly 128B, a spreader brace 148B is secured to and extends between leg members 138B, 140B of the leg assembly 128B. These spreader braces 148A, 148B resist both compression (i.e., a force that moves the feet 142 and 144 towards one another) and tension (i.e., a force that moves the feet 142 and 144 away from one another).

This preferred construction of the trestle 110, specifically the attachment of the leg assemblies 128A, 128B relative to the crossbeam 112, provides the trestle 110 with desired rotational stability. Referring now to the side view of the preferred trestle 110 in FIG. 7, the vertical separation, $h_1$, between the pin connections that pivotally secure the leg assemblies 128A, 128B to the crossbeam 112 is important to ensuring desired rotational stability of the crossbeam 112. In this regard, with each of the four feet 142A, 144A, 142B, 144B of the trestle 110 resting firmly on the underlying terrain, the orientation of the crossbeam 112 is essentially locked, preventing the crossbeam 112 from rotating in either direction about an axis longitudinal to crossbeam 112, as indicated by arrow 62.

Figure 7:
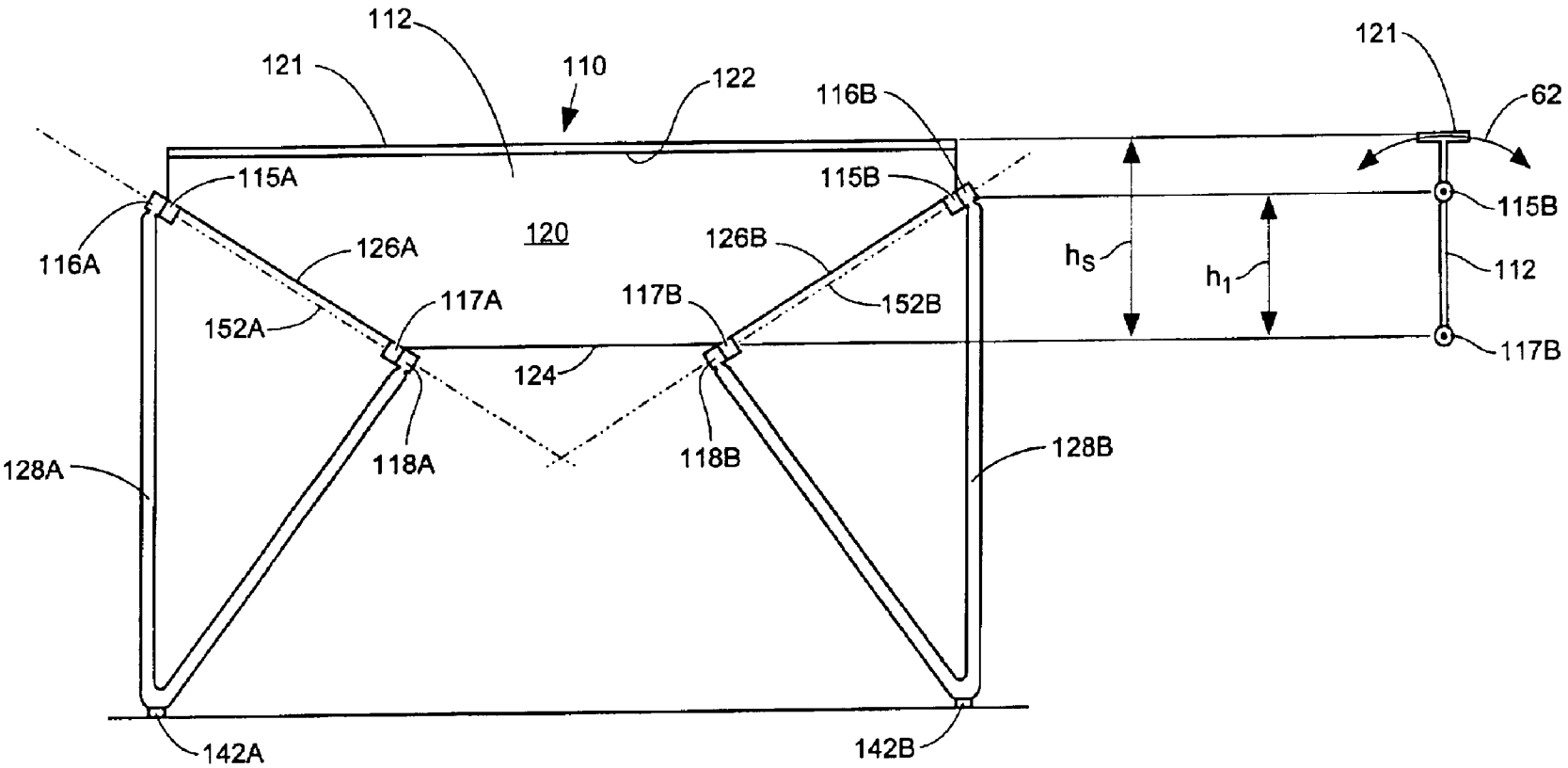
FIG. 7 is a side view of the self-stabilizing trestle of FIG. 4, similar to the side view of FIG. 5, but further illustrating the principle of rotational stability of the crossbeam of the self-stabilizing trestle.
Figure 8:
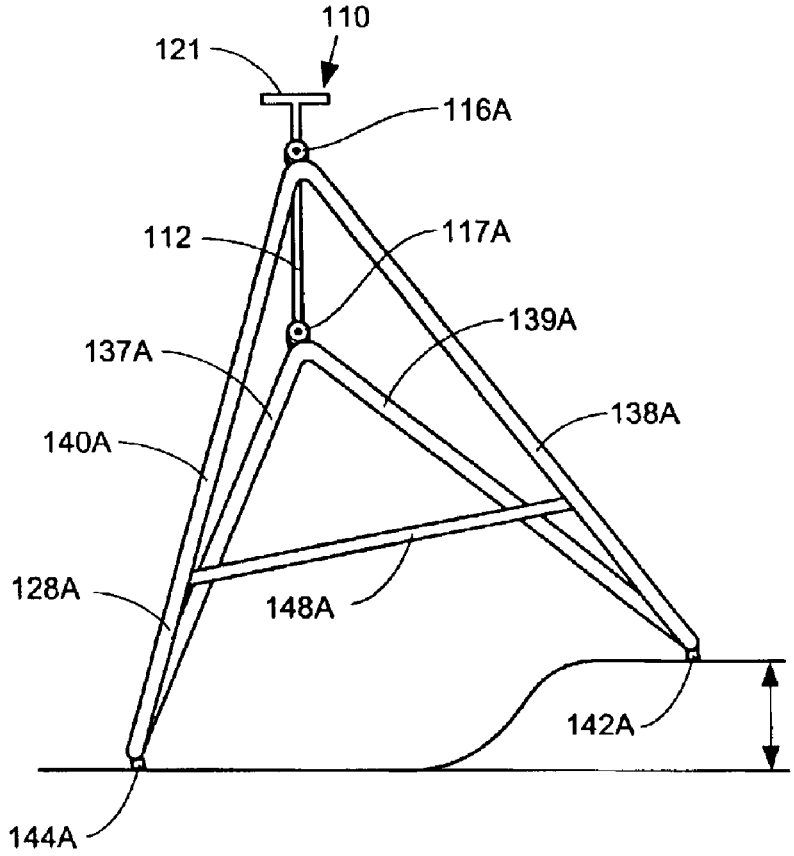
FIG. 8 is an end view of the self-stabilizing trestle of FIG. 4, similar to the end view of FIG. 6, further illustrating how a leg assembly of the self-stabilizing trestle rotates relative to the crossbeam to adjust to uneven terrain.

FIG. 8 is an end view of the preferred self-stabilizing trestle 110 similar to the end view of FIG. 6, but further illustrating how the legs of the self-stabilizing trestle 110 rotate relative to the crossbeam 112 to accommodate uneven terrain. As shown in FIG. 8, the trestle 110 is positioned on uneven terrain with one of its feet 142A resting on a raised ground surface, while feet 144A, 142B (not shown) and 144B (not shown) are in the same substantially horizontal plane. Despite this positioning of the trestle 110 on uneven terrain, the crossbeam 112 does not rotate in either direction about an axis longitudinal to the crossbeam 112, as indicated by arrow 62 in FIG. 7, so long as the leg assembly 128B does not rotate (i.e., the feet 142B, 144B do not move). In other words, since the leg assemblies 128A, 128B pivot independently of one another, all feet can be on a differing vertical level.

As stated above, the rotation axes 152A, 152B of trestle 110 are each oriented at a predetermined acute angle $\alpha$ relative to the support surface defined by the crossbeam 112. Provided the axes 152A, 152B are oriented at an acute angle $\alpha$, the trestle 110 will provide for the desired rotational stability of crossbeam 112 while also providing for the necessary self-adjustment of the legs to accommodate uneven terrain.

Nevertheless, there are practical restraints to the pivoting of the leg assemblies 128A, 128B relative to the crossbeam 112. For example, tipping can occur if one or both of the leg assemblies 128A, 128B is rotated such that the weight of the load supported by the crossbeam 112 acts outside of the leg assemblies 128A, 128B.

Operational Principle and Parameters

In operation, the self-stabilizing characteristics of a trestle 110 made in accordance with the present invention are dependent on the ability of the feet to slip relative the underlying terrain. For the trestle 110 to self-stabilize on uneven terrain, the feet need to slip over the underlying terrain in a direction parallel to the crossbeam 112, as illustrated by arrows 88F, 88R in FIG. 9.

The slippage of each foot can be quantified in terms of a "slippage ratio," which is the amount of horizontal travel of a foot in the x-direction (as illustrated by arrows 88F, 88R) divided by the amount of vertical travel (in the y-direction) of that same foot as a leg assembly 128 rotates, as will be further described below. More importantly, for purposes of the present discussion, the slippage ratio can be mathematically correlated to the axis orientation angle ($\alpha_A$ or $\alpha_B$). Note that, as a leg assembly 128 rotates, both feet will slip. Although the vertical and the horizontal travel will be different for each foot, the proportions of vertical travel to horizontal travel will be the same for each foot, and therefore, both feet of a leg assembly 128 will always have the same slippage ratio. It also follows that the sum of the horizontal travel of both feet divided by the sum of vertical travel of both feet results in the same slippage ratio.

Since the feet have to slip in the x-direction in order for trestle 110 to self-stabilize itself properly, the friction between the feet and the underlying terrain is relevant. As will be explained in the following description, the amount of the frictional force is mathematically correlated to the slippage ratio, and thus to the axis orientation angle ($\alpha_A$ or $\alpha_B$).

In order for the feet to slip as intended, the frictional force has to be overcome by a friction counterforce. As will be explained in the following description, there is an effective limit to the frictional counterforce, which is also mathematically correlated to the axis orientation angle ($\alpha_A$ or $\alpha_B$).

Friction, or slip resistance, is a force that prevents an object from sliding with respect to the surface it rests upon:

$$F=W*\mu \quad (1)$$

where F is friction, W is weight of the object, and $\mu$ is the static coefficient of friction. In this regard, the static coefficient of friction is dependent on the nature of the interface between the object and the underlying surface. At the interface, the asperities (i.e., the microscopic peaks and valleys) of the object and the underlying surface contact one another. Since there are no tribological models capable of predicting static friction coefficients theoretically, the static coefficients of friction need to be estimated through empirical methods. For purposes of the present invention, since the object (i.e., the feet of the trestle) can be constructed from various materials and the trestle can be positioned on a variety of surfaces, it is necessary to consider a range of values for the static coefficient of friction. Nevertheless, it is assumed and preferred that, since the shape, smoothness, and material of the feet of the trestle have a significant impact on the static coefficient of friction, that (1) the shape of the feet minimize "plowing into" soft surfaces; (2) the bottom surfaces of the feet are smooth, i.e., have minimal asperity depth; and (3) the material of the feet resist load deformation, which can result in large asperities in the underlying surface. Based on these considerations, examples of suitable materials for construction of the feet include crystalline polymers, such as nylon and acetal, which have both self-lubricating properties and resist load deformation, resulting in a low coefficient of friction on most surfaces. If a low-friction polymer, polished metal, or similar material is used to construct the feet of the trestle, its is estimated that the static coefficient of friction will range between 0.14 (on a smooth marble floor) to 0.26 (on asphalt or rough concrete.)

Figure 10:
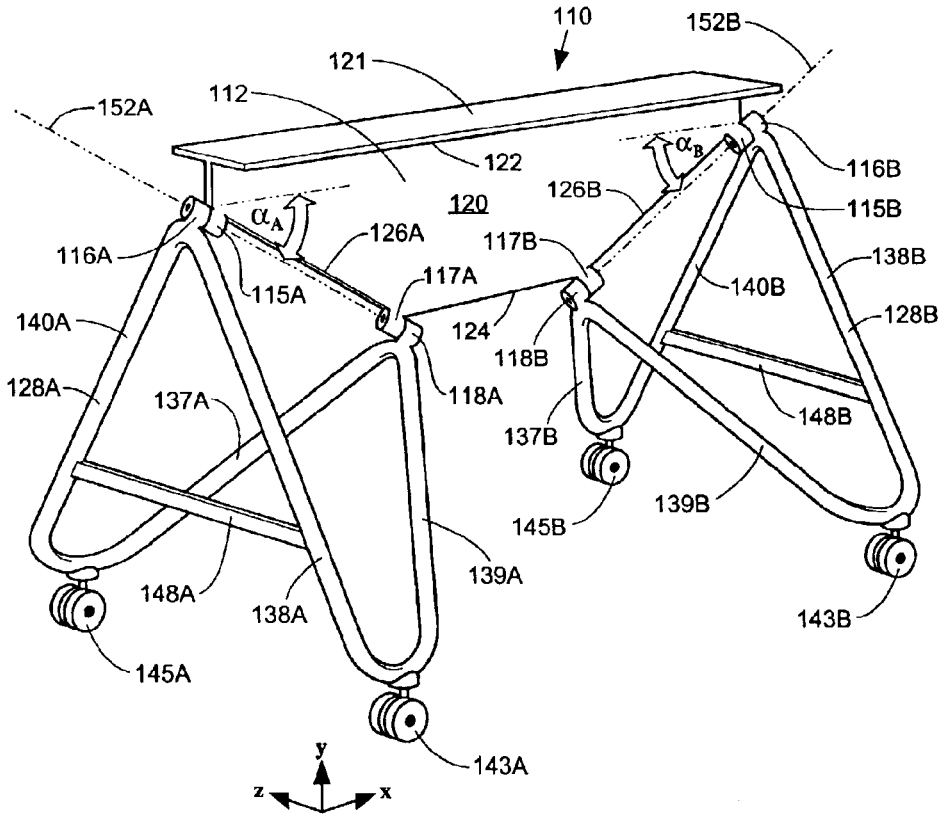
FIG. 10 is a perspective view of an alternate preferred embodiment of a self-stabilizing trestle made in accordance with the present invention where the trestle includes wheels.

To further minimize friction between the feet of the trestle and the underlying surface, in one alternate embodiment, the feet are mounted on wheels or casters 143A, 143B, 145A, 145B, as illustrated in FIG. 10. With such wheels, the resistive force is dramatically reduced as the rolling coefficient of friction is usually significantly less than the static coefficient of friction. If the feet of the trestle 110 are mounted on wheels, it is estimated that the rolling coefficient of friction will range between 0.01 (on a smooth marble floor) to 0.17 (on soft surfaces where the wheels have a tendency to plow into the surface to some extent.)

In any event, the "slippage" of the feet of the trestle of the present invention is essential to the self-stabilizing properties of the trestle. If the trestle is placed on an entirely slip-resistant surface (i.e., a static coefficient of friction$\geqq$5.0), the trestle will not automatically adjust and "self-stabilize." It is estimate that the trestle 110 of the present invention will perform as intended up to a static coefficient of friction of 0.38, as explained in further detail below.

Figure 9:
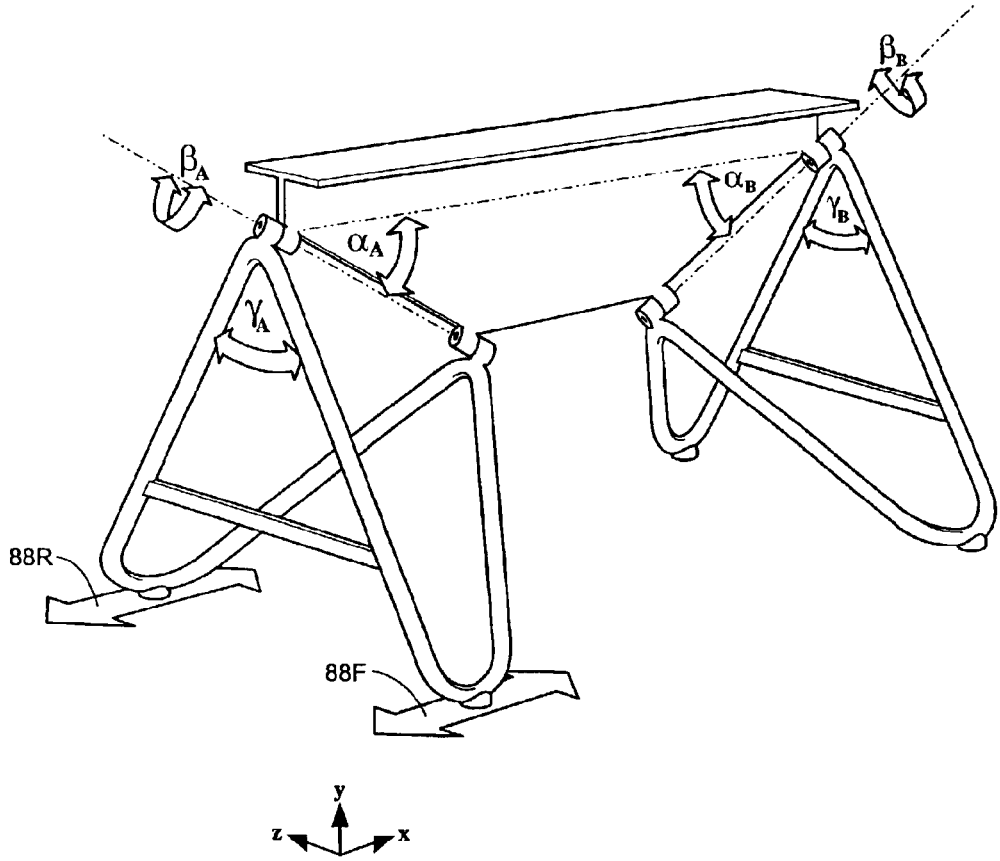
FIG. 9 is another perspective view of the self-stabilizing trestle of FIG. 4, illustrating the angles, dimensions, and motions relevant to the self-stabilizing properties of the trestle.

To determine the optimal range of self-stabilizing performance, the mathematical relationships between the following five factors of the trestle are important:

1. The axis orientation angle ($\alpha_A$ or $\alpha_B$), the angle at which each axis of rotation 152A, 152B is oriented relative to the support surface defined by the crossbeam 112, as shown in FIG. 9. In this regard, it is not essential that the axes be oriented at the same angle, but it is preferred that $\alpha_A=\alpha_B$ for symmetric behavior of the leg assemblies 128A, 128B;

2. The axis rotation angle ($\beta_A$ or $\beta_B$), the angle through which each leg assembly 128A, 128B rotates relative to the crossbeam, as shown in FIG. 9;

3. The leg diversion angle ($\gamma_A$ or $\gamma_B$), the angle between the leg members 138, 140 of each leg assembly 128A, 128B, as shown in FIG. 9. The leg diversion angle ($\gamma_A$ or $\gamma_B$), together with the height of the trestle 110, determines the lateral distance between the front foot 142 and the rear foot 144 of each leg assembly 128A, 128B. Again, it is not essential that the legs be diverted at the same angle, but it is preferred that $\gamma_A=\gamma_B$ for symmetric behavior of the leg assemblies 128A, 128B;

4. The coefficient of friction between each foot and the underlying surface; and 5. The limits of friction counterforce, i.e., the force necessary to overcome the frictional force between the feet and the underlying surface.

Then, the best mode of operation of the present invention depends on three primary properties: (a) the slip resistance (friction) between the feet and the underlying surface the trestle 110 is resting on; (2) the load the trestle 110 is expected to support; and (c) the axis orientation angle $\alpha$ (assuming $\alpha=\alpha_A=\alpha_B$). Essentially, the objective is to determine an optimal axis orientation angle $\alpha$ based on an estimate of the slip resistance (friction) and projected load capacity.

To establish the optimal axis orientation angle $\alpha$, three conflicting attributes have to be reconciled:

1. Rotational Stability of the crossbeam 112: As discussed above with reference to FIG. 7, as the vertical separation, h1, between the pin connections that pivotally secure the leg assemblies 128A, 128B to the crossbeam 112 is increased, the rotational stability of the crossbeam 112 improves. The vertical separation, h1, can be calculated by multiplying the sine of the axis orientation angle $\alpha$ by the distance between the endpoints 115A, 117A (hinge knuckles) of the side edge 126A, as described above with reference to FIG. 7. Assuming a fixed distance between the endpoints 115A, 117A, the larger the axis orientation angle $\alpha$, the greater the rotational stability of the crossbeam 112.

2. Crossbeam Strength: The taller the web portion 120 of crossbeam 112, the greater the load the crossbeam 112 can support. In this regard, the height, $h_s$, of the web portion 120 is the sum of the vertical separation, h1, between the pin connections and any vertical extension above the pin connections. Assuming a constant vertical extension and a fixed distance between hinge knuckles 115 and 117, the larger the axis orientation angle $\alpha$, the greater the load that can be supported by the crossbeam 112.

3. Friction: For ease of adjustment, the friction should be as small as possible. In the regard, the smaller the slippage ratio, the smaller the friction. The smaller the axis orientation angle $\alpha$, the smaller the slippage ratio. Therefore, the smaller the axis orientation angle $\alpha$, the easier it is for the legs to adjust to uneven terrain.

Exploring further the relationship between the axis orientation angle ($\alpha_A$ or $\alpha_B$), the axis rotation angle ($\beta_A$ or $\beta_B$), the leg diversion angle ($\gamma_A$ or $\gamma_B$), coefficients of friction, and counterforce limits, some assumptions are made. These assumptions facilitate an explanation of the self-stabilizing properties of the trestle 110 of the present invention, but do not imply restrictions or limitations on the present invention. First, it is assumed that the legs 138A, 140A of the first leg assembly 128A and the legs 138B, 140B of the second leg assembly 128B each lie in a plane substantially perpendicular to the underlying terrain, as best illustrated in FIG. 5. It is also assumed that all hinges are frictionless. Furthermore, it is assumed that the "weight," the gravitational force, is a constant of one. By assuming a constant weight of one, the weight does not factor into the mathematical relationships between the various angles, motions, and forces; in other words, the friction F is equal to the static coefficient of friction, $\mu$. To further simplify the discussion, it is assumed that each leg assembly 128A, 128B is weightless, and that the crossbeam 112, including any carried load, has a weight of one. Of course, although weight is not important for discussion of the mathematical relationships between the axis orientation angle ($\alpha_A$ or $\alpha_B$), the axis rotation angle ($\beta_A$ or $\beta_B$), the leg diversion angle ($\gamma_A$ or $\gamma_B$), friction, and counterforce limits, weight is certainly a factor in determining the required strength of the crossbeam. Finally, for purposes of illustrating the various mathematical relationships, the length of a leg (the distance between foot 142 or 144 and the hinge knuckle 116) is set at 33 inches.

Based on the foregoing assumptions, various factors must be considered in arriving at the optimal leg diversion angle ($\gamma_A$ or $\gamma_B$).

First, to ensure that the trestle 110 operates without tipping as the leg assemblies 128A, 128B rotate, the leg diversion angle ($\gamma_A$ or $\gamma_B$) should be as large as practicable. A large leg diversion angle ($\gamma_A$ or $\gamma_B$) ensures that the weight of the load supported by the crossbeam 112 acts "inside" of the leg assemblies 128A, 128B. If the leg diversion angle ($\gamma_A$ or $\gamma_B$) is too small, the trestle 110 may be prone to tipping. From this perspective, it is desirable for the leg diversion angle ($\gamma_A$ or $\gamma_B$) to be as large as possible. At the same time, if the leg diversion angle ($\gamma_A$ or $\gamma_B$) is too large, the leg assemblies 128A, 128B will occupy a significant space, making use of the trestle 110 inconvenient. From this perspective, it is desirable for the leg diversion angle ($\gamma_A$ or $\gamma_B$) to be as small as possible.

It is also important to consider the vertical adjustment capacity of the trestle 110, i.e., how much higher one foot of a leg assembly can be as compared to the other foot of that same leg assembly, as illustrated in FIG. 8. Referring still to FIG. 8, with a smaller leg diversion angle $\gamma_A$, the vertical adjustment capacity between the two feet 142A, 144A of the leg assembly 128A will be smaller. For example, assuming that legs 138A, 140A of the leg assembly 128A are 33 inches long, the axis rotation angle $\beta_A$ is 15°, and the leg diversion angle $\gamma_A$ is 50°, then the vertical adjustment capacity is 6.9 inches. Assuming the same leg length of 33 inches, the same axis rotation angle $\beta_A$ of 15°, but with a leg diversion angle $\gamma_A$ increased to 60°, then the vertical adjustment capacity is increased to 8.1 inches.

Finally, and most importantly, the correlation between the axis orientation angle ($\alpha_A$ or $\gamma_B$) and the frictional forces must be examined in detail.

As stated above, the frictional forces are mathematically correlated to the slippage ratio, and thus to the axis orientation angle ($\alpha_A$ or $\alpha_B$); specifically, the slippage ratio is equal to the tangent of the axis orientation angle ($\alpha_A$ or $\alpha_B$). The slippage ratio is important because it compounds the frictional force between a foot and the underlying surface as a leg assembly rotates. In this description, this compounded frictional force is called the "friction factor," and the base frictional force is the static coefficient of friction. The base static coefficient of friction applies when the slippage ratio is 0%, which is when the axis orientation angle ($\alpha_A$ or $\alpha_B$) is 0°. The friction factor applies when the axis orientation angle ($\alpha_A$ or $\alpha_B$) is larger than 0°. Since the slippage ratio is equal to the tangent of the axis orientation angle ($\alpha_A$ or $\alpha_B$), the static coefficient of friction is to be increased by the proportion represented by this tangent in order to arrive at the friction factor value. Mathematically, this is expressed as:

$$\text{Friction Factor}=\mu_1 * W*(1+\tan(\alpha)) \quad (2)$$

Where $\mu_1$ is the static coefficient of friction of the interface between a foot and the underlying surface. Since we assume that W=1, it follows that:

$$\text{Friction Factor}=\mu_1 *(1+\tan(\alpha)) \quad (3)$$

Figure 11:
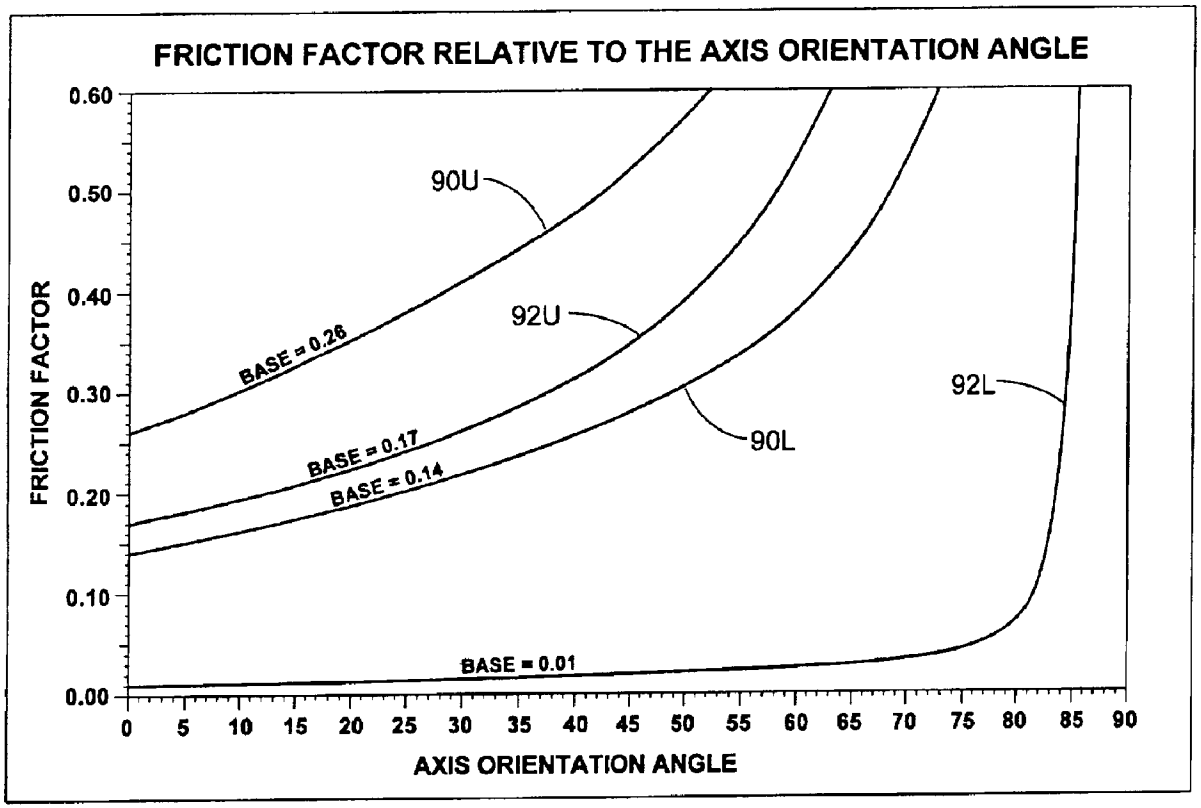
FIG. 11 is a chart illustrating the relationship between (a) the friction factor (for four different bases) between the feet of the leg assemblies and the underlying terrain, and (b) the axis orientation angle for a preferred self-stabilizing trestle.

FIG. 11 is a chart illustrating the relationship between (a) the friction factor (for four static coefficient of friction base values) between the feet of the leg assemblies and the underlying terrain, and (b) the axis orientation angle $\alpha$, based on equation (3) above. As illustrated, as the axis orientation angle $\alpha$ increases, the friction factor likewise increases. As mentioned above, if a low-friction polymer, polished metal, or similar material is used to construct the feet of the trestle, it is estimated that the static coefficient of friction will range between 0.14 (on a smooth marble floor) to 0.26 (on asphalt or rough concrete). In FIG. 11, line 90U shows the relationship between the friction factor and the axis orientation angle $\alpha$, assuming a high static coefficient of friction of 0.26. Line 90L shows the relationship between the friction factor and the axis orientation angle $\alpha$, assuming a low static coefficient of friction of 0.14. Similarly, line 92U shows the relationship between the friction factor and the axis orientation angle $\alpha$, assuming a high rolling coefficient of friction of 0.17 for a trestle on wheels (FIG. 10). Line 92L shows the relationship between the friction factor and the axis orientation angle $\alpha$, assuming a low rolling coefficient of friction of 0.01.

As described above, as a leg assembly begins to adjust to uneven terrain, the force that overcomes the frictional forces between a foot and the underlying terrain is the friction counterforce. As with the friction factor, this friction counterforce is mathematically correlated to the axis orientation angle ($\alpha_A$ or $\alpha_B$).

The friction counterforce is generated as gravity rotates a leg assembly 128, but then only the gravity that acts perpendicular to the axis of rotation 152. The friction counterforce is the weight of the carried load acting perpendicular to the axis of rotation 152. The proportion of the weight that acts on a leg assembly 128 such as to cause the horizontal movement of the feet 142, 144 of that leg assembly can be determined by calculating the cosine of the axis orientation angle $\alpha$. Mathematically this is expressed as:

$$\text{Friction Counterforce}=W*\mu_2*\cos(\alpha) \quad (4)$$

Where $\mu_2$ is the coefficient of friction of the counterforce limit (estimated to be 0.38). Since we assume that W=1, it follows that:

$$\text{Friction Counterforce}=\mu_2*\cos(\alpha) \quad (5)$$

If the axis orientation angle $\alpha$ were zero, one hundred percent (100%) of the weight of the carried load would be acting in a direction perpendicular to the axis of rotation 152. At a 30° axis orientation angle $\alpha$, only eighty-seven percent (87%) of the weight would act perpendicularly to the axis of rotation 152. Thus, the smaller the axis orientation angle $\alpha$, the greater effect of the weight of the carried load acting perpendicularly to the axis of rotation 152, the greater the friction counterforce, and thus the easier the trestle 110 self-stabilizes through the movement of the leg assemblies 128A, 128B.

Figure 12:
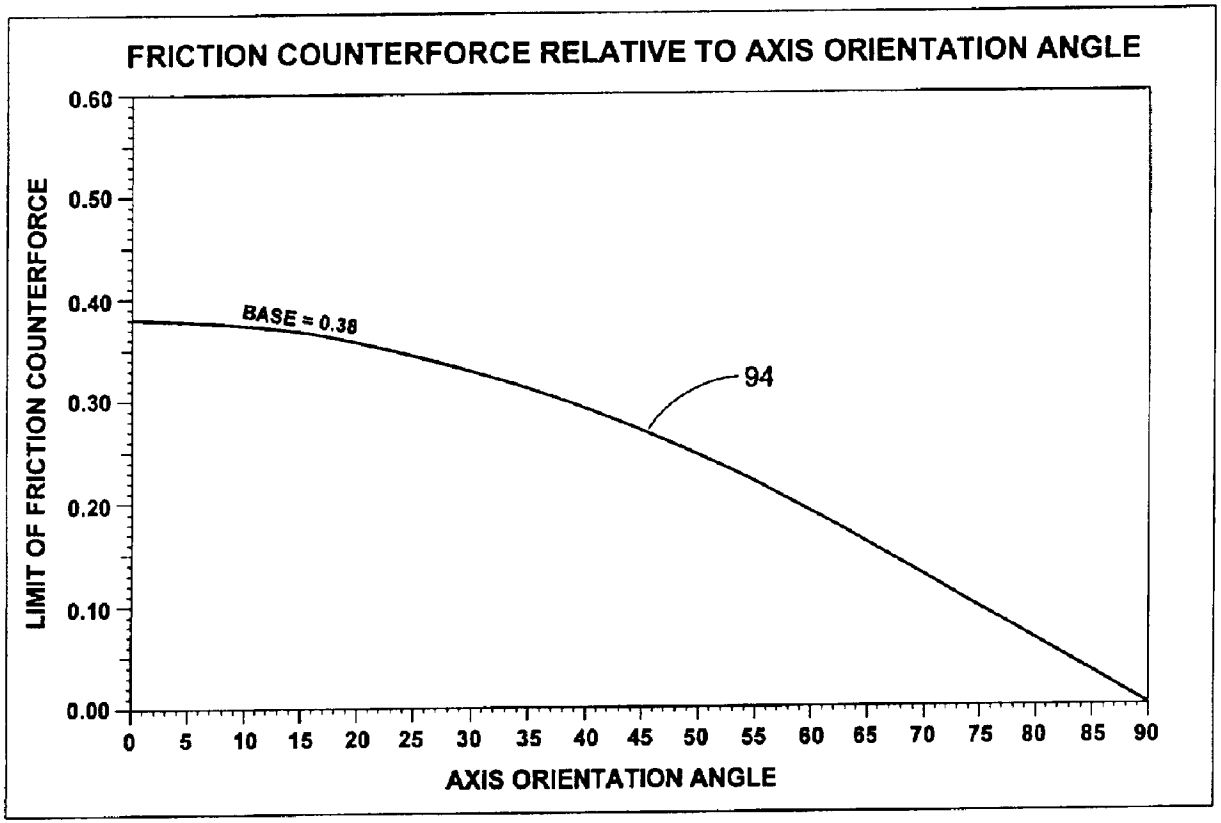
FIG. 12 is a chart illustrating the relationship between (a) the limit of the friction counterforce, and (b) the axis orientation angle for a preferred self-stabilizing trestle.

As stated above, it is estimated that the upper coefficient of friction limit within which the trestle is estimated to operate as intended is 0.38. FIG. 12 is a chart illustrating the relationship between (a) the effective limit of the friction counterforce, and (b) the axis orientation angle, based on equation (5) above. As shown by line 94, the limit of effective friction counterforce starts at 0.38 (static coefficient of friction base value) where axis orientation angle ($\alpha_A$ or $\alpha_B$) is 0°. As the axis orientation angle ($\alpha_A$ or $\alpha_B$) increases, line 94 shows how friction counterforce decreases relative to the axis orientation angle ($\alpha_A$ or $\alpha_B$).

Thus, when the axis orientation angle ($\alpha_A$ or $\alpha_B$) increases, the friction factor increases, while the force that counteracts this friction decreases, as indicated by line 94. In order for the trestle 110 to self-stabilize itself as intended, the friction counterforce has to be larger than friction factor. This leads to a limit in the ability of the trestle 110 to stabilize itself. This limit is reached when the friction factor is equal to the force that counteracts that friction. Thus, mathematically, the trestle 110 will perform for all values of a as long as the following is true:

$$\mu_1*(1+\tan(\alpha))<\mu_2*\cos(\alpha) \quad (6)$$

where $\mu_1$ is the coefficient of friction of the interface between a foot and the underlying surface and $\mu_2$ is the coefficient of friction of the counterforce limit.

Figure 13:
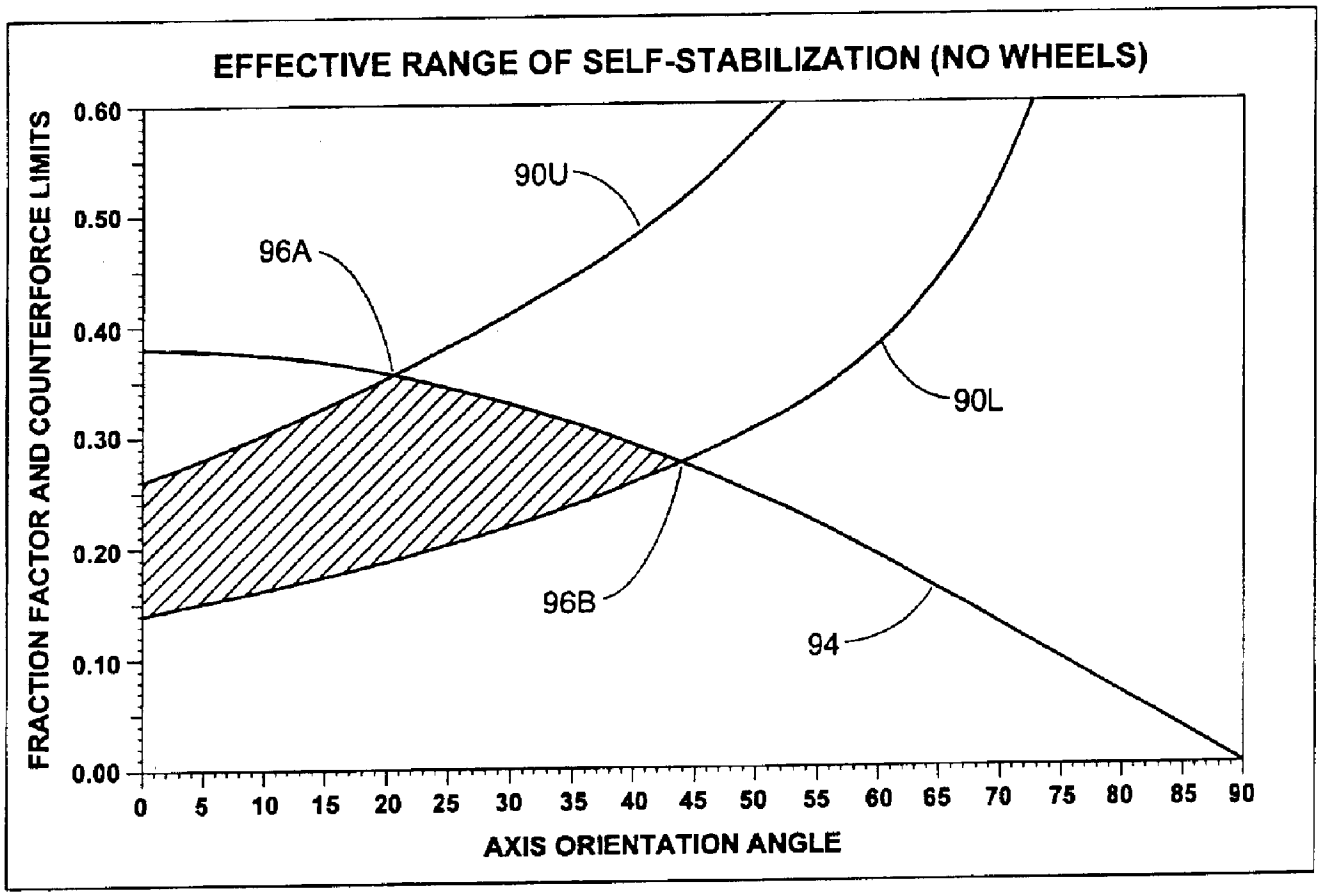
FIG. 13 is a chart illustrating the relationship between (a) the friction factor for the two bases of a trestle without wheels, (b) the limit of the friction counterforce, and (c) the axis orientation angle, a relationship which indicates the range for which a preferred self-stabilizing trestle will perform as intended.

FIG. 13 combines the friction factors 90L, 90U for feet without wheels with the friction counterforce limit 94. FIG. 13 shows the range in which the trestle 110 (without wheels) is estimated to perform as intended. The intersection 96B of the counterforce limit 94 with the lower friction factor 90L defines the largest axis orientation angle ($\alpha=\alpha_A=\alpha_B$) at which the self-stabilizing properties are estimated to perform. This intersection corresponds with an axis orientation angle ($\alpha=\alpha_A=\alpha_B$) of 43.8°. The intersection 96A of the counterforce limit 94 with the upper friction factor 90U defines the largest axis orientation angle ($\alpha=\alpha_A=\alpha_B$) that encompasses the entire range of friction coefficients. This intersection corresponds with an axis orientation angle of 20.3°. Thus, for a general purpose trestle 110, which needs to be as strong and stable as possible (i.e., the vertical separation, $h_1$, between the hinge knuckles is as high as possible) and which is to be used on the broadest range of surfaces (i.e., the broadest range of coefficients of friction) an axis orientation angle ($\alpha=\alpha_A=\alpha_B$) of 20.3° is preferred.

Figure 14:
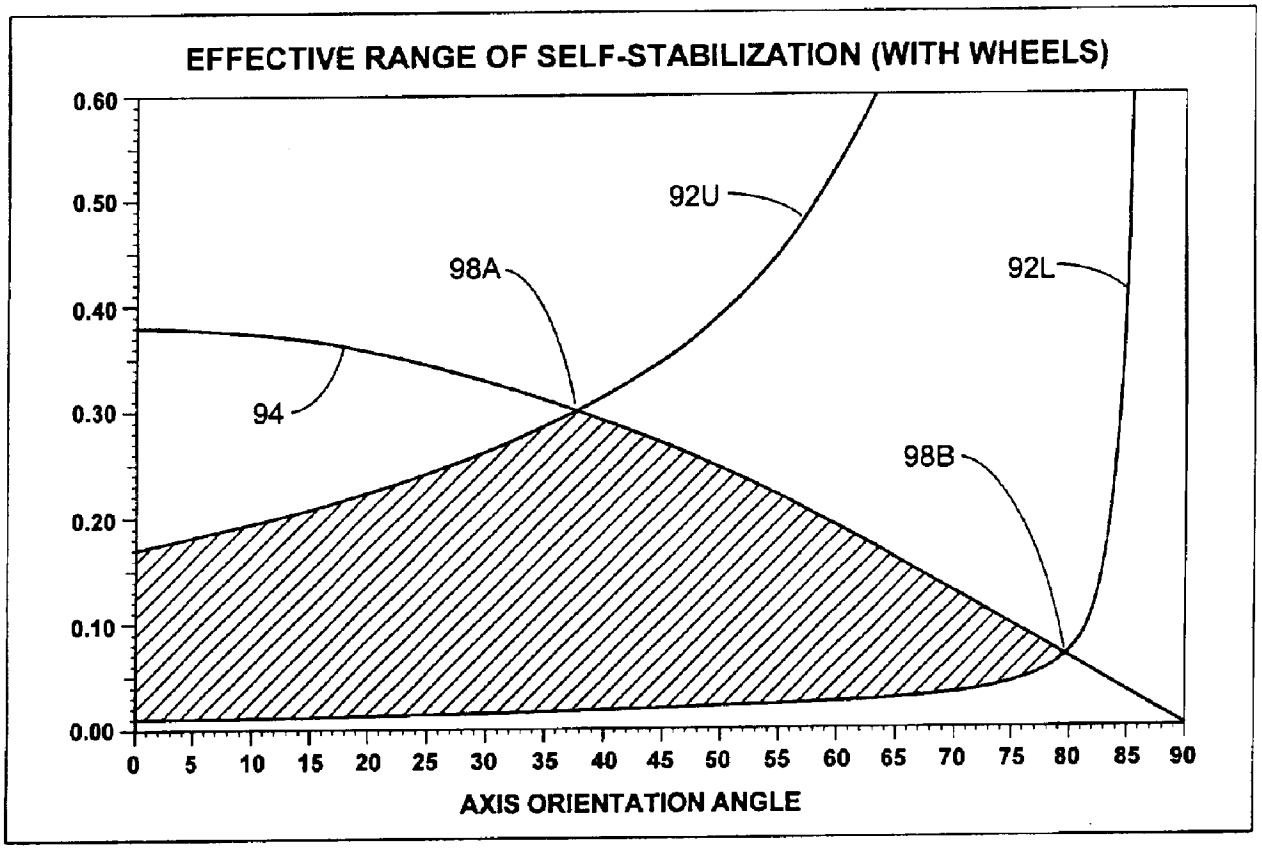
FIG. 14 is a chart illustrating the relationship between (a) the friction factor for the two bases of a trestle with wheels, (b) the limit of the friction counterforce, and (c) the axis orientation angle, a relationship which indicates the range for which a preferred self-stabilizing trestle with wheels will perform as intended.

Similarly, FIG. 14 combines the friction factors 92L, 92U for feet with wheels with the friction counterforce limits 94. FIG. 14 shows the range in which the trestle 110 (with wheels) is estimated to perform as intended. The intersection 98B of the counterforce limit 94 with the lower friction factor 92L defines the highest axis orientation angle ($\alpha=\alpha_A=\alpha_B$) at which the self-stabilizing properties are estimated to perform. This intersection corresponds to an axis orientation angle ($\alpha=\alpha_A=\alpha_B$) of 79.9°. The intersection 98A of the counterforce limit 94 with the upper friction factor 92U defines the highest axis orientation angle ($\alpha=\alpha_A=\alpha_B$) that encompasses the entire range of friction coefficients. This intersection corresponds to an axis orientation angle ($\alpha=\alpha_A=\alpha_B$) of 37.6°. Thus, for a general purpose trestle 110 on wheels, which needs to be as strong as possible (i.e., the vertical separation, $h_1$, between the hinge knuckles is as high as possible) and which is to be used on the broadest range surfaces (i.e., the broadest range of coefficients of friction) an axis orientation angle ($\alpha=\alpha_A=\alpha_B$) of 37.6° is preferred.

Descriptions of Alternate Embodiments

Figure 15:
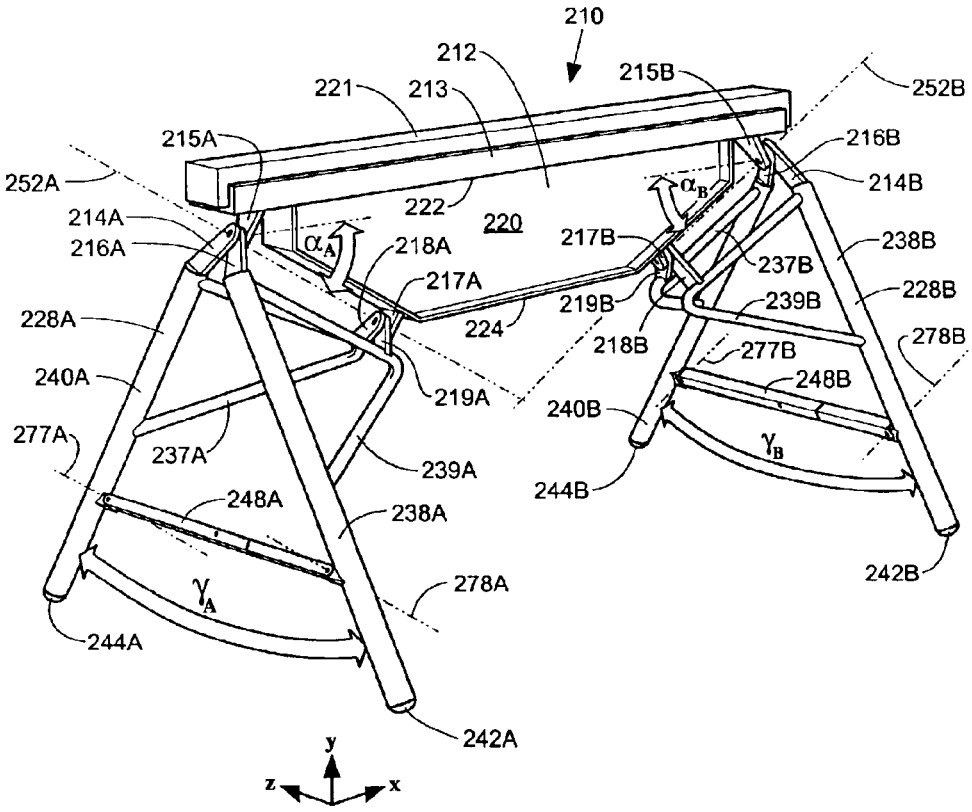
FIG. 15 is a perspective view of an alternate preferred embodiment of a self-stabilizing trestle made in accordance with the present invention.
Figure 16:
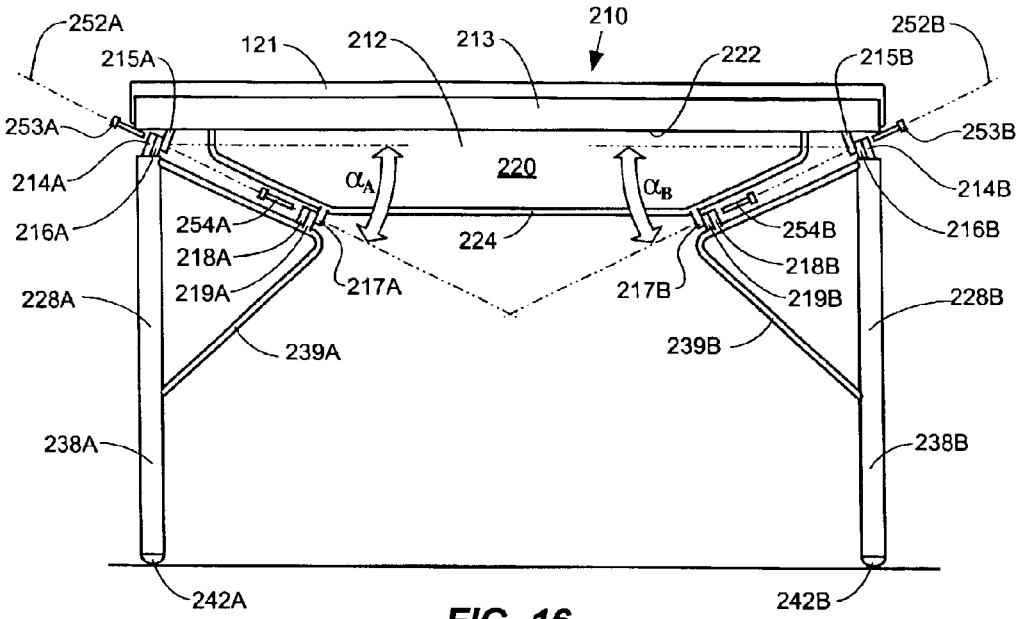
FIG. 16 is a side view of the self-stabilizing trestle of FIG. 15.
Figure 17:
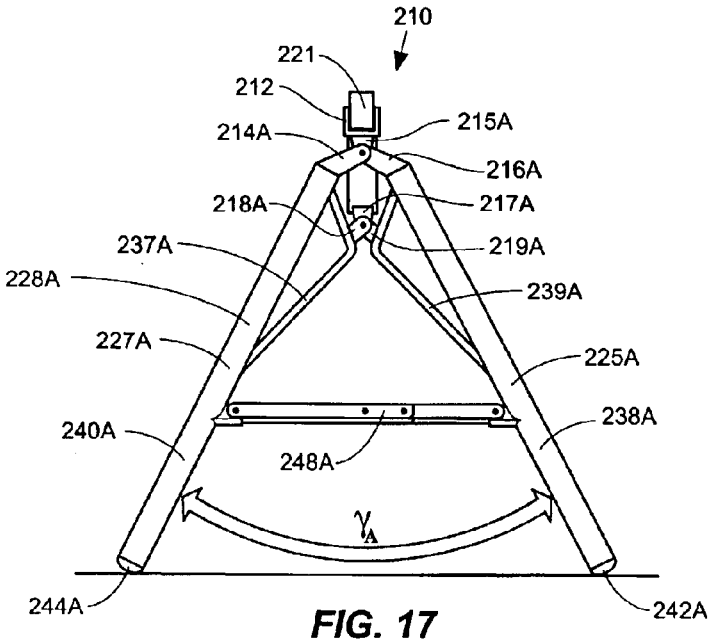
FIG. 17 is an end view of the self-stabilizing trestle of FIG. 15.

FIGS. 15, 16, and 17 show a third alternate embodiment of a self-stabilizing trestle 210 made in accordance with the present invention, showing how the leg assemblies 228A, 228B can be folded in, i.e., leg diversion angle $\gamma$ can be reduced to zero for easier storage and transportation. In other words, whereas trestles 10, 110 (FIGS. 1–10) use a rigid tetrahedral structure for its leg assemblies 28A, 28B, 128A, 128B, this trestle 210 has leg assemblies 228A 228B that can be collapsed (folded) for easier storage and transportation. Specifically, each hinge has three knuckles, one for the crossbeam 212, and one each for the leg 238A and the leg 240A. Thus, a single hinge serves two purposes: (1) to fold the legs, and (2) to rotate a leg assembly relative to the crossbeam 212. Applicant is unaware of any prior art in which folding is used to reduce size and independent pivoting is used to self-stabilize through a single hinge axis.

The trestle 210 is generally comprised of a substantially horizontal crossbeam 212 that is supported by first and second leg assemblies 228A, 228B. The crossbeam 212 has a web portion 220 and an upper rail 213, which supports a wooden saddle 221. The wooden saddle 221 defines a substantially horizontal support surface. The upper rail 213 is perpendicularly secured to the vertical plate 220 along the upper base edge 222 of the web. As best shown in FIGS. 15 and 16, the web portion 220 of the crossbeam 212 is preferably a substantially trapezoidal plate that has parallel upper and lower base edges 222, 224.

Attached to the upper and outer corners of the crossbeam 212 are the hinge knuckles 215A, 215B, and attached to the lower and inner corners of the crossbeam 212 are the hinge knuckles 217A, 217B.

In this preferred embodiment, the first leg assembly 228A consists of a leg 238A, to which a lateral arm 239A is attached, and a second leg 240A, to which a second lateral arm 237A is attached. Attached to the top of the leg 238A is a hinge knuckle 216A, and a hinge knuckle 219A is also attached to the lateral arm 239A. Similarly, attached to the top of leg 240A is a hinge knuckle 214A, and a hinge knuckle 218A is also attached to the lateral arm 237A. The legs 238A, 240A also are provided with low-friction feet 242A, 244A. Geometrically, the hinge knuckle 216A, hinge knuckle 219A and foot 242A essentially form a triangular plane. Similarly, the hinge knuckle 214A, hinge knuckle 218A and foot 244A essentially form a triangular plane.

Both the leg 238A and the leg 240A are operably and pivotally connected to the crossbeam 212 with a hinge pin (not shown) passing through the hinge knuckles 214A, 215A, and 216A; and another hinge pin (not shown) passing through the hinge knuckles 217A, 218A, and 219A. This pair of hinge pins that connects the legs 238A, 240A to the crossbeam 212 is coaxial and defines an axis of rotation 252A that is oriented at a predetermined acute angle $\alpha_A$ relative to the support surface defined by the crossbeam 212. The importance of selecting an appropriate orientation angle $\alpha_A$ has been described above.

The second leg assembly 228B is constructed in the same manner as the leg assembly 228A and, as it is attached to the crossbeam 212 in the same manner as leg assembly 228A, the leg assembly 228B also operates in the same manner.

Geometrically, the two rotation axes 252A, 252B are coplanar but not coaxial. The two rotation axes 252A, 252B intersect below the wooden saddle 221 of the crossbeam 212. In addition, the longitudinal axis of the crossbeam 212 (the upper flange edge 222) and the two rotation axes 252A, 252B are essentially coplanar and effectively define a triangle, pointing downward.

In addition to the leg 238A and the leg 240A, the leg assembly 228A includes a foldable spreader brace 248A, which on one end is preferably attached to the leg 238A though a pivotable rivet, having the axis 277A, and on the other side through a rivet defining an axis 278A. In this embodiment, where the leg assemblies 228A, 228B can fold, the properties of the spreader brace 248A are relevant. Without the spreader brace 248A, each leg 238A and 240A would be able to pivot independently, which is antithetical to the operating principle of self-stabilization. For the trestle 210 to self-stabilize properly, both legs 238A, 240A of the leg assembly 228A have to act in unison, and the distance between the feet 242A and 244A has to remain constant. In other words, once the spreader brace 248A is in the operational, locked position, the leg diversion angle ($\gamma=\gamma_A=\gamma_B$) has to be fixed. Furthermore, to maintain the integrity of the tetrahedral structure, the spreader brace 248A, once locked, has to withstand both compression (i.e., the force that moves the feet 242A and 244A towards one another) and tension (i.e., the force that moves the feet 242A and 244A away from one another) forces.

The distance between the feet 242A, 244A has to be maintained through tension because if the trestle 210 is placed on uneven terrain, the foot that first touches the ground will be pushed upwardly relative to the crossbeam 212. The foot being pushed upward, which slips in one direction, has to pull the foot that is not yet supported downward, which then slips in the opposing direction.

The distance between the feet 242A, 244A also has to be maintained through compression as, once the trestle 210 is placed on uneven terrain, one of the feet will not yet touch the ground. If a leg does not touch the ground, without a spreader brace 248A that withstands compression, that leg would follow the path of least resistance, which is to fold in, since the gravitational force needed for the leg to fold in is less than the friction counterforce. As a result, the leg diversion angle $\gamma_A$ decreases until the leg gains support by touching the ground. This means that the non-supported leg does not generate slippage, which requires more force than folding in. In short, without slippage, there is no self-stabilization. Also, as the leg diversion angle $\gamma_A$ decreases, the propensity of tipping increases as it is more likely that the weight acts outside the leg assembly 226A.

Again, as mentioned above and clearly illustrated in FIGS. 15 and 16, the second leg assembly 228B is constructed in the same manner and operated in the same manner as the first leg assembly 228A.

Figure 18A:
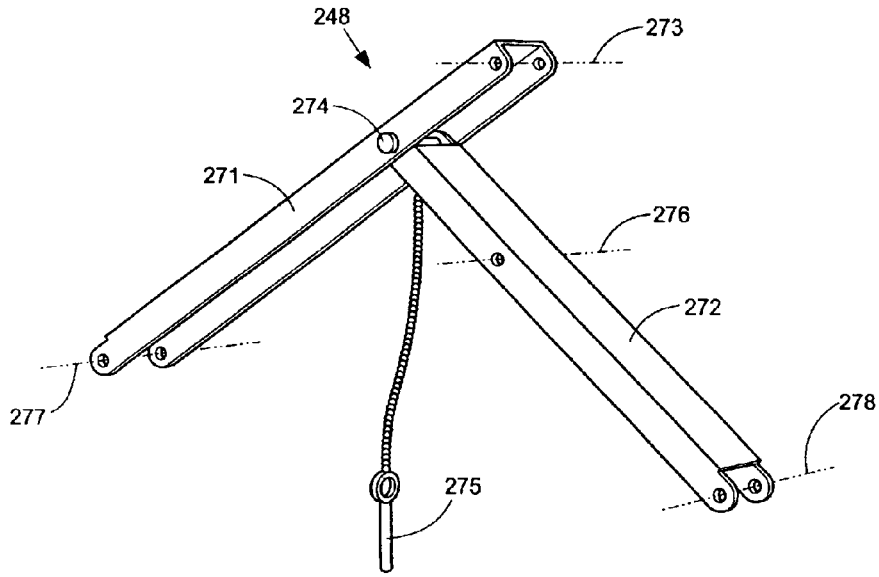
FIG. 18A is a perspective view of a spreader brace for the self-stabilizing trestle of FIG. 15 in a partially folded, open position.
Figure 18B:
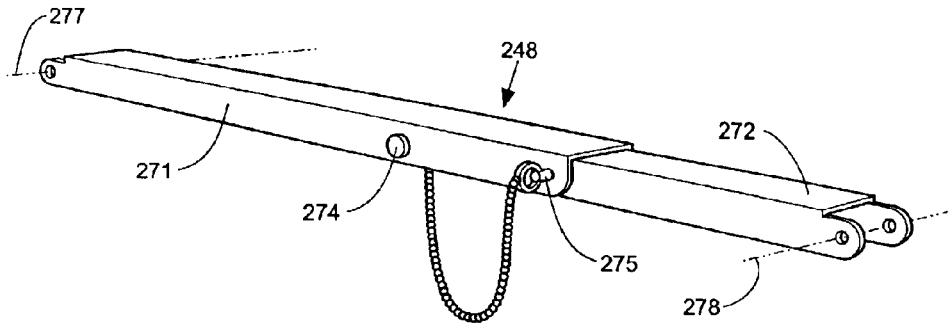
FIG. 18B is a perspective view of the spreader brace of FIG. 18A in a fully extended, closed position.

FIGS. 18A and 18B illustrate a preferred spreader brace 248. As shown, the spreader brace 248 preferably comprises a left arm 271, a right arm 272, and a middle hinge 274. The spreader brace 248 is attached to a leg assembly 228 with rivets that pass through holes defining axes 277, 278. Since the spreader brace 248 has to withstand compression and resist buckling, it is important that, when trestle 210 is in its operational position, the spreader brace 248 has to lock. This locking is accomplished by extending the spreader brace such that the holes through the respective arms 271, 272, defining axes 273, 276 are in a coaxial relationship such that a locking pin 275 can be used to lock the arms 271, 272 with respect to one another, as shown in FIG. 18B. As a straight, rigid body, compression forces are transferred in a straight line through the spreader brace 248. As a result, the locked spreader brace 248 will withstand compression and resist buckling. It should be noted that the two axes 277, 278 that constitute the points at which the spreader brace 248 is attached to the legs 238, 240 of a leg assembly 228 should be substantially parallel to the rotation axis 252 to avoid strain in the hinges when the legs 238, 240 are folded towards one another (i.e., the leg diversion angle $\gamma$ is reduced to zero).

Referring again to FIGS. 15–17, once the spreader brace 248A is locked, the leg assembly 228 has a generally rigid tetrahedral structure with each of the hinge endpoints forming a vertex and each of the feet forming a vertex.

Note that, even though the trestle 210 can be collapsed along the rotation axes 252A, 252B for easier storage and transportation, it is exceedingly difficult to also fold the respective legs 238, 240 parallel to the crossbeam 212, as disclosed by Proctor (U.S. Pat. No. 1,680,065) Shapiro (U.S. Pat. No. 5,007,502) and Martin (U.S. Pat. No. 5,626,205).

Whereas the preferred embodiment of the trestle 210 as described with reference to FIGS. 15–17 has a single rotation axis 252A, 252B per leg assembly 228A, 228B, the leg assemblies 328A, 328B of the fourth preferred embodiment, trestle 310, shown in FIGS. 19–22 each have two substantially parallel rotation axes 351, 352 per leg assembly 328A, 328B.

Figure 19:
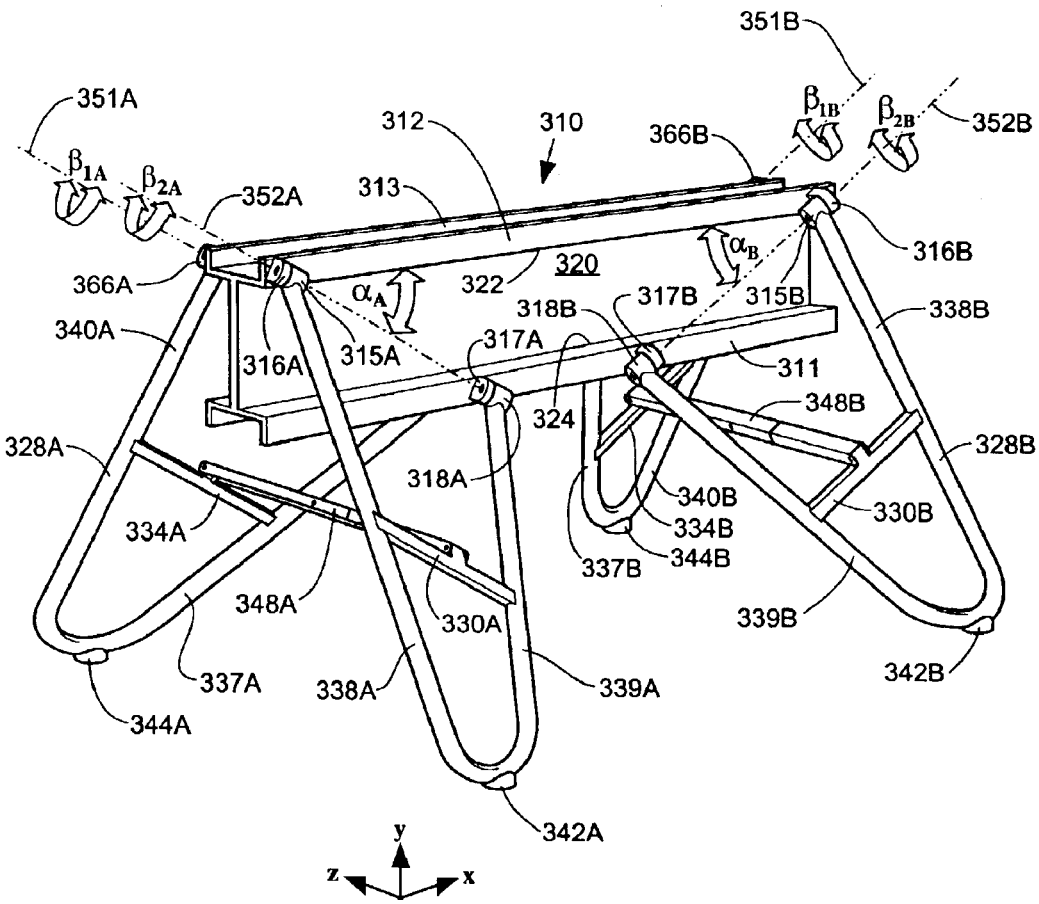
FIG. 19 is a perspective view of an alternate preferred embodiment of a self-stabilizing trestle made in accordance with the present invention having two axes of rotation per leg assembly.
Figure 21:
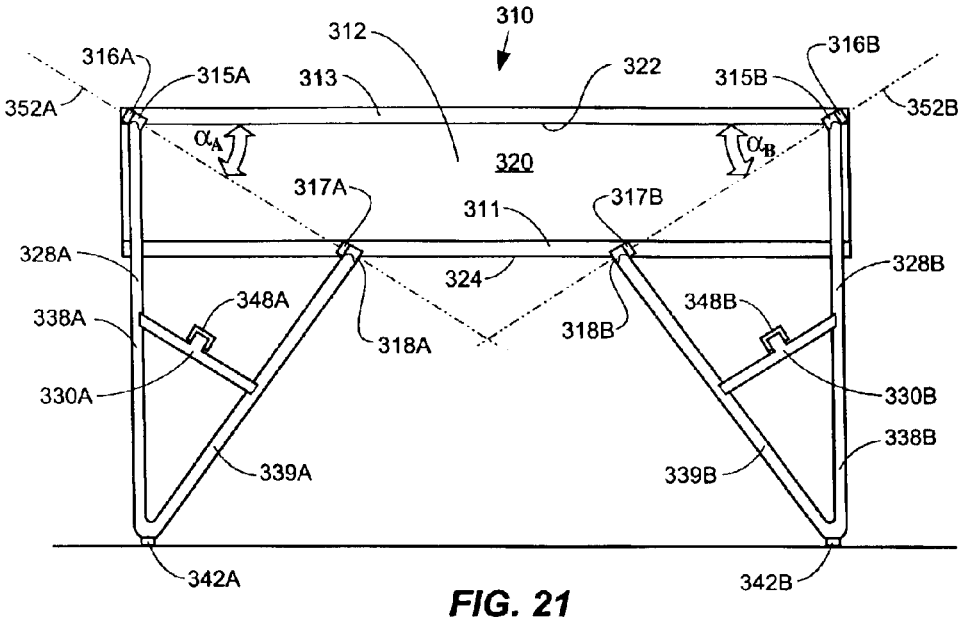
FIG. 21 is a side view of the self-stabilizing trestle of FIG. 19.

The trestle 310 is generally comprised of a substantially horizontal crossbeam 312 that is supported by first and second leg assemblies 328A, 328B. The crossbeam 312 has an upper rail 313 that defines a substantially horizontal support surface, a lower rail 311, and a web portion 320 that extends between the upper rail 313 and the lower rail 311. As best shown in FIGS. 19 and 21, the web portion 320 of the crossbeam 312 is a plate that has parallel upper and lower base edges 322, 324. The upper rail 313 is secured to the web portion 320 along the upper base edge 322 of the plate, while the lower rail 311 is secured to the web portion 320 along the lower base edge 324.

The first leg assembly 328A consists of tubular leg members 338A, 339A, tubular leg members 337A, 340A, and a spreader brace 348A. The leg member 338A has a hinge knuckle 315A at its upper distal end; the leg member 339A has a hinge knuckle 318A at its upper distal end; the leg member 340A has a hinge knuckle 365A at its upper distal end; and the leg member 337A has a hinge knuckle 368A at its upper distal end. A foot 342A lies substantially at the intersection of the leg members 338A and 339A, and a mounting plate 330A extends between the leg members 338A and 339A. A foot 344A also lies substantially at the intersection of the leg members 340A and 337A, and another mounting plate 334A extends between the leg members 340A and 337A.

Figure 22:
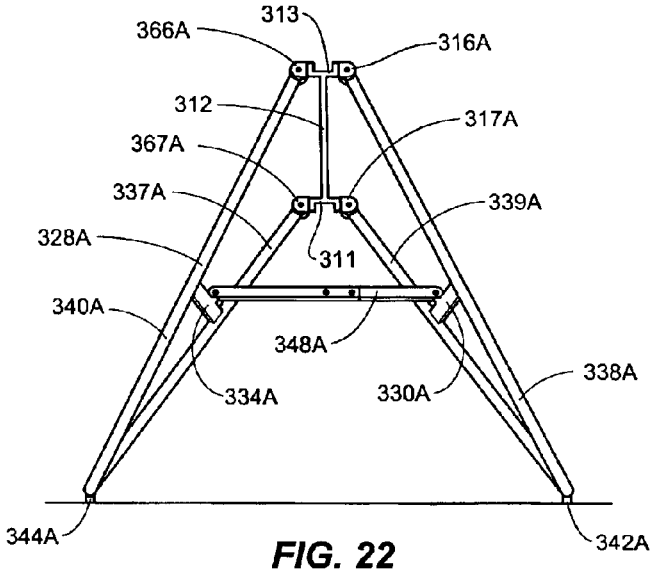
FIG. 22 is an end view of the self-stabilizing trestle of FIG. 19.

The leg assembly 328A is pivotally secured to the crossbeam 312 using by hinge knuckles 316A, 366A that are secured on each side of the upper rail 313, and the hinge knuckles 317A, 367A (as best shown in FIG. 22) that are secured on each side of the lower rail 311. As described above, there is a corresponding pair of hinge knuckles 316A, 365A, 318A and 368A extending from the leg assembly 328A. Thus, the first leg assembly 328A is operably and pivotally connected to the crossbeam 312 by passing a first hinge pin (not shown) through the upper hinge knuckles 315A, 316A; a second hinge pin (not shown) through the upper hinge knuckles 365A, 366A; a third hinge pin (not shown) through the lower hinge knuckles 317A, 318A; and a fourth hinge pin (not shown) through the lower hinge knuckles 367A, 368A. The hinge pins that connect the leg members 338A, 339A of the leg assembly 328A to the crossbeam 312 through the hinge knuckles 315A, 316A, 317A, and 318A define a common axis of rotation 352A that, similar to the embodiment illustrated in FIG. 9, is oriented at a predetermined acute angle $\alpha_A$ relative to the support surface defined by the crossbeam 312. The hinge pins that connect the leg members 337A, 340A of the leg assembly 328A to the crossbeam 312 through the hinge knuckles 365A, 366A, 367A, and 368A also define a common axis of rotation 351A that, similar to the embodiment illustrated in FIG. 9, is oriented at a predetermined acute angle $\alpha_A$ relative to the support surface defined by the crossbeam 312. The importance of selecting an appropriate orientation angle $\alpha_A$ for these rotation axes 352A, 351A has been explained above.

Similarly, the second leg assembly 328B is pivotally secured to the crossbeam 312 using by hinge knuckles 316B, 366B that are secured on each side of the upper rail 313, and the hinge knuckles 317B, 367B that are secured on each side of the lower rail 311. As described above, there is a corresponding pair of hinge knuckles 316B, 365B, 318B and 368B extending from the leg assembly 328B. Thus, the first leg assembly 328B is operably and pivotally connected to the crossbeam 312 by passing a first hinge pin (not shown) through the upper hinge knuckles 315B, 316B; a second hinge pin (not shown) through the upper hinge knuckles 365B, 366B; a third hinge pin (not shown) through the lower hinge knuckles 317B, 318B; and a fourth hinge pin (not shown) through the lower hinge knuckles 367B, 368B. The hinge pins that connect the leg members 338B, 339B of the leg assembly 328B to the crossbeam 312 through the hinge knuckles 315B, 316B, 317B, and 318B define a common axis of rotation 352B that, similar to the embodiment illustrated in FIG. 9, is oriented at a predetermined acute angle $\alpha_B$ relative to the support surface defined by the crossbeam 312. The hinge pins that connect the leg members 337B, 340B of the leg assembly 328B to the crossbeam 312 through the hinge knuckles 365B, 366B, 367B, and 368B also define a common axis of rotation 351B that, similar to the embodiment illustrated in FIG. 9, is oriented at a predetermined acute angle $\alpha_B$ relative to the support surface defined by the crossbeam 312. The importance of selecting an appropriate orientation angle $\alpha_B$ for these rotation axes 352B, 351B has been explained above.

The two rotation axes 352A, 352B of this trestle 310 are preferably substantiality coplanar, but not coaxial. The two rotation axes 352A, 352B intersect one another below the rail 313 of the crossbeam 312. In addition, the longitudinal axis of the crossbeam 312 (the upper base edge 322) and the two rotation axes 352A, 352B are essentially coplanar and effectively define a triangle, pointing downward. Similarly, the two rotation axes 351A, 351B are preferably substantiality coplanar, but not coaxial. The two rotation axes 351A, 351B also intersect one another below the rail 313 of the crossbeam 312. In addition, the longitudinal axis of the crossbeam 312 (the upper base edge 322) and the two rotation axes 351A, 3511B are essentially coplanar and effectively define a triangle, pointing downward. Note that, although it is preferred that the axes 351, 352 are parallel, it is not essential for self-stabilization. It is preferred that the respective rotation axes 351, 352 on each end of the crossbeam 312 are parallel to one another to avoid undue strain on the hinges of the spreader braces 348A, 348B. If the axes 351, 352 are not parallel to one another, the hinge 274, as shown in FIG. 18, should have significant tolerance (i.e., play) or be a ball joint.

The feet 342A, 344A, 342B, 344B are the components of the leg assemblies 328A, 328B that actually contact the underlying terrain. The front and rear feet 342A, 344A, 342B, 344B of each leg assembly 328A, 328B are spaced apart from one another across the bisecting plane defined by the web portion 320 of the crossbeam 312. The first spreader brace 348A, similar to the one illustrated in FIG. 18, is pivotally secured to the mounting plates 330A and 334A, and ensures that a fixed distance is maintained between the feet 342A, 344A of the first leg assembly 328A. The second spreader brace 348B, also similar to the one illustrated in FIG. 18, is pivotally secured to the mounting plates 330B and 334B, and ensures that a fixed distance is maintained between the feet 342B, 344B of the second leg assembly 328B.

This preferred construction of the trestle 310, specifically the attachment of the leg assemblies 328A, 328B relative to the crossbeam 312, provides the trestle 310 with desired rotational stability of the crossbeam 312, using the same principle as illustrated in FIG. 7. With each of the four feet 342A, 344A, 342B, 344B of the trestle 310 resting firmly on the underlying terrain, the orientation of the crossbeam 312 of trestle 310 is essentially locked, preventing the crossbeam 312 from rotating in either direction about an axis longitudinal to the crossbeam 312, as indicated by arrow 62 in FIG. 7.

Figure 23:
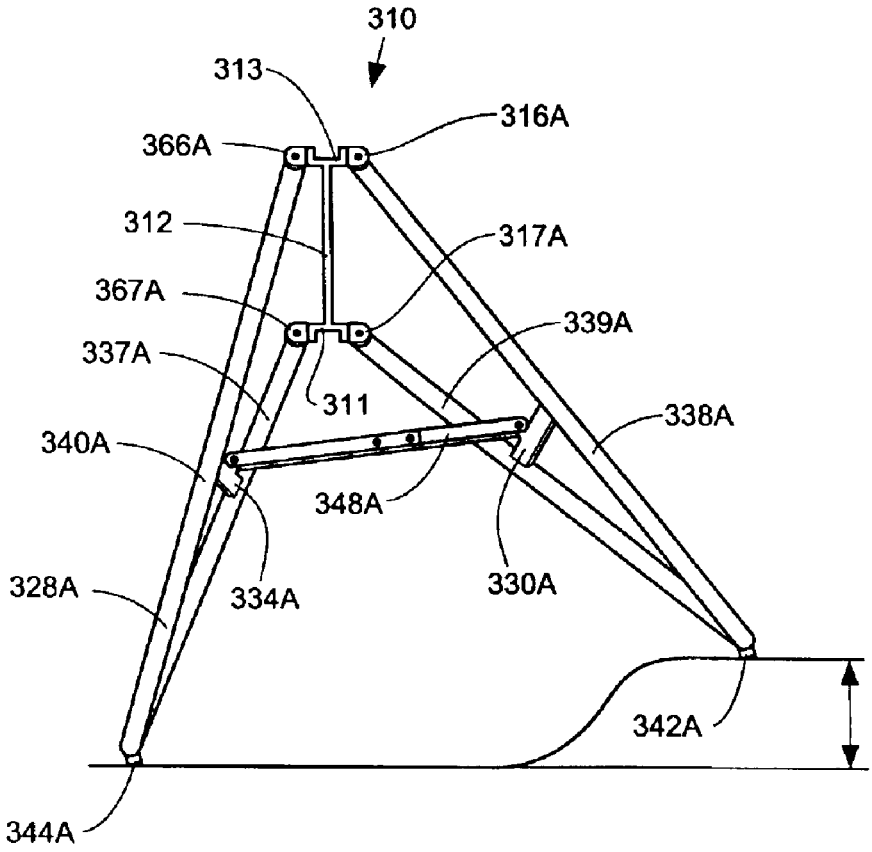
FIG. 23 is an end view of the self-stabilizing trestle of FIG. 19, similar to the end view of FIG. 22, further illustrating how a leg assembly of the self-stabilizing trestle rotates relative to the crossbeam to adjust to uneven terrain.

FIG. 23 is an end view of the preferred self-stabilizing trestle 310 similar to the end view of FIG. 22, but further illustrating how the legs of the self-stabilizing trestle 310 rotate relative to the crossbeam 312 to adjust to uneven terrain. As shown in FIG. 23, the trestle 310 is positioned on uneven terrain with one of its feet 342A resting on a raised ground surface while the feet 344A, 342B (not shown) 344B (not shown) are in the same substantially horizontal plane. Despite this positioning of the trestle 310 on uneven terrain, the crossbeam 312 does not rotate in either direction about an axis longitudinal to the crossbeam 312, so long as the leg assembly 328B does not rotate (i.e., the feet 342B, 344B do not move). In other words, since the leg assemblies 328A 328B pivot independently of one another, all feet can be on a differing vertical level.

Tipping can occur if one or both of the leg assemblies 328A, 328B is rotated such that the weight of the load supported by the crossbeam 312 acts outside of the leg assemblies 328A, 328B. Therefore, the practical restraints to the pivoting of the leg assemblies 328A, 328B relative to the crossbeam 312 should stay within the ±15° operating range to prevent tipping. This range allows for a safety margin of ±10°.

Figure 20:
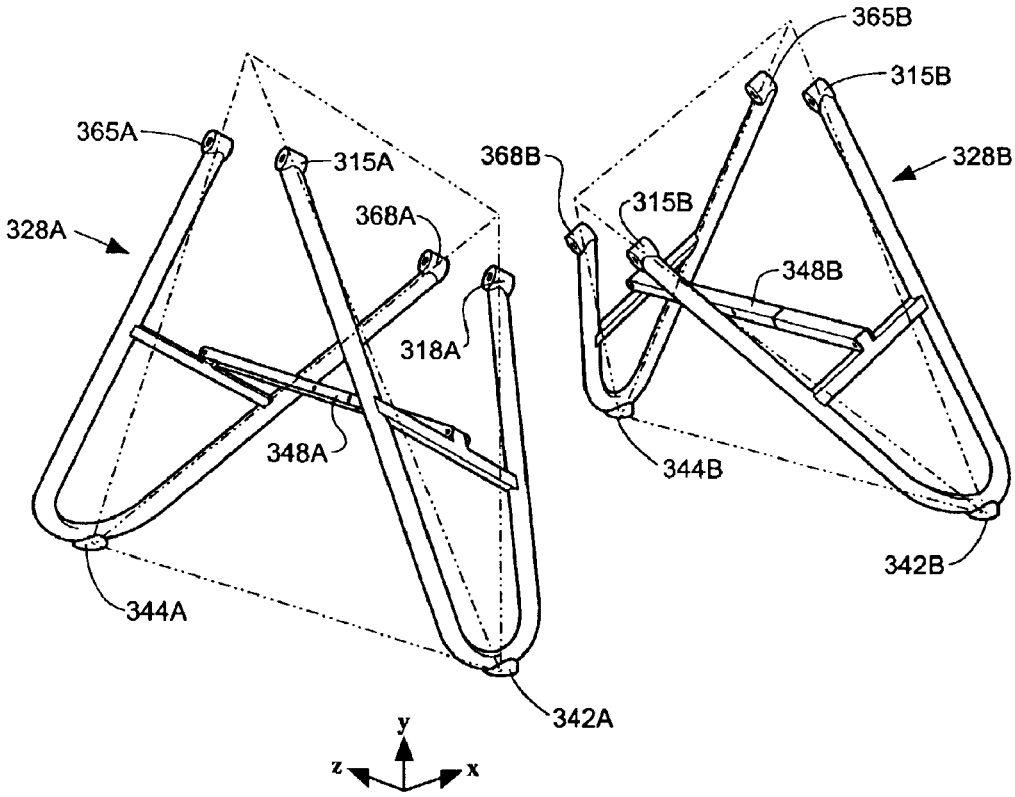
FIG. 20 is a perspective view of the self-stabilizing of FIG. 19, with the crossbeam removed to show additional detail.

In operation, the axis rotation angle $\beta_{1A}$ of 351A≈the axis rotation angle $\beta_{2A}$ of 352A, and the axis rotation angle $\beta_{1B}$ of 351B≈the axis rotation angle $\beta_{B2}$ of 352B. Given the close proximity of the respective axes 351, 352 on either end of the crossbeam 312 and the ±15° operating range, the deviation between the axis rotation angle $\beta_{1A}$ of 351A and the axis rotation angle $\beta_{2A}$ of 352A is never more than 0.5°, and therefore the slippage ratio, the friction factor, and the friction counterforce are essentially the same for each foot 342A, 344A of the leg assemblies 328A. Similarly, the deviation between the axis rotation angle $\beta_{1B}$ of 351B and the axis rotation angle $\beta_{2B}$ of 352B is never more than 0.5°, and therefore the slippage ratio, the friction factor, and the friction counterforce are essentially the same for each foot 342B, 344B of the leg assemblies 328B. In other words, for purposes of the mathematical calculations, these parallel axes 351, 352 can be considered a single axis of rotation (i.e., $\beta_{1A}=\beta_{2A}$ and $\beta_{1B}=\beta_{2B}$.) Nevertheless, as the result of this minuscule deviation, the two tetrahedral structures defined by the two leg assemblies 328A, 328B as shown in FIG. 20 will slightly deform during self-stabilizing action. This very small deformation is absorbed by the various axes (351, 352 between the leg assembly and the crossbeam, and 277, 278, as shown in FIG. 18, which are the two axes that attach the spreader brace 348 to the mounting plates 330, 334) that are substantially parallel. As such, all the individual components that make up a leg assembly 328 are still perfectly rigid. Also, the feet 342, 344 always rest firmly on the underlying terrain while the crossbeam 312 has rotational stability. Given these characteristics, with the two rotational axes 351, 352 per leg assembly 328, the trestle 310 achieves its self-stabilizing purpose using essentially the same operating principle and parameters as if there were only one rotational axis per leg assembly.

FIGS. 24, 25, 26, and 27 show a fifth alternate embodiment of a self-stabilizing trestle 410 made in accordance with the present invention, showing how the coplanar, non-coaxial rotation axes 451A, 451B intersect above the crossbeam 412, and similarly, how the coplanar, non-coaxial rotation axes 452A, 452B intersect above the crossbeam 412.

Figure 24:
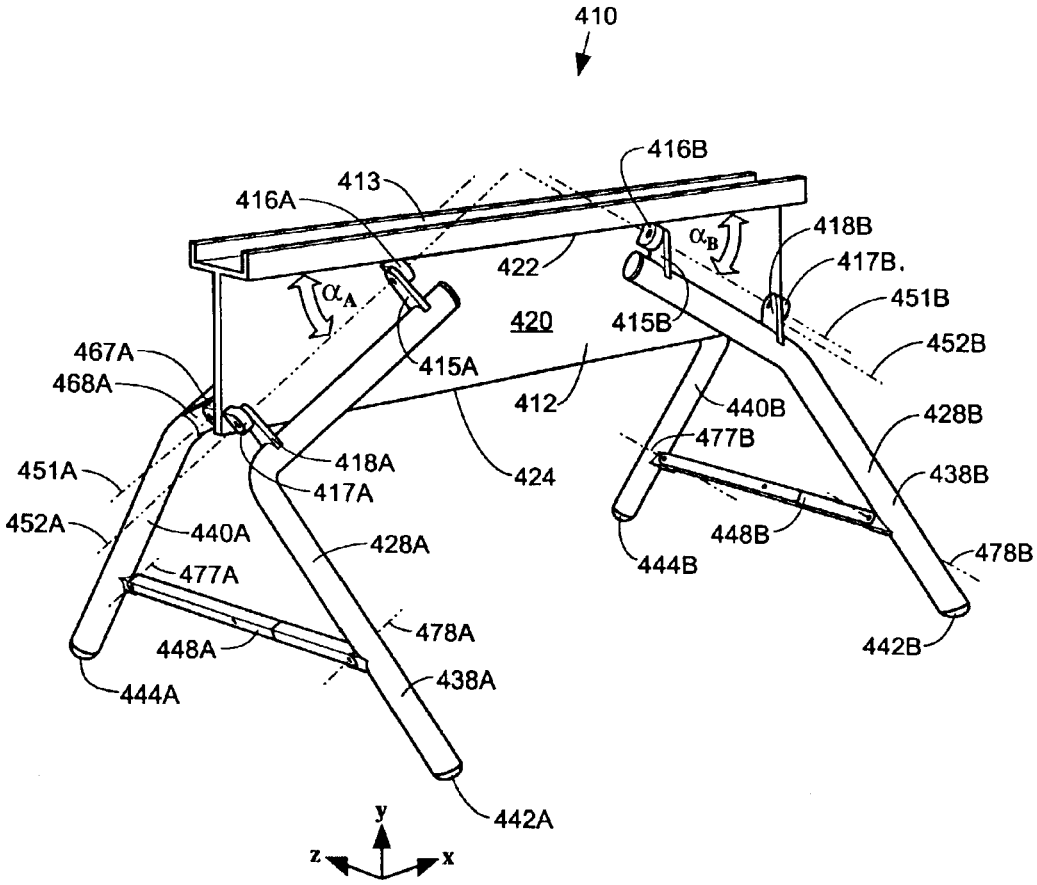
FIG. 24 is a perspective view of an alternate preferred embodiment of a self-stabilizing trestle made in accordance with the present invention having two axes of rotation per leg assembly that intersect above the crossbeam.
Figure 25:
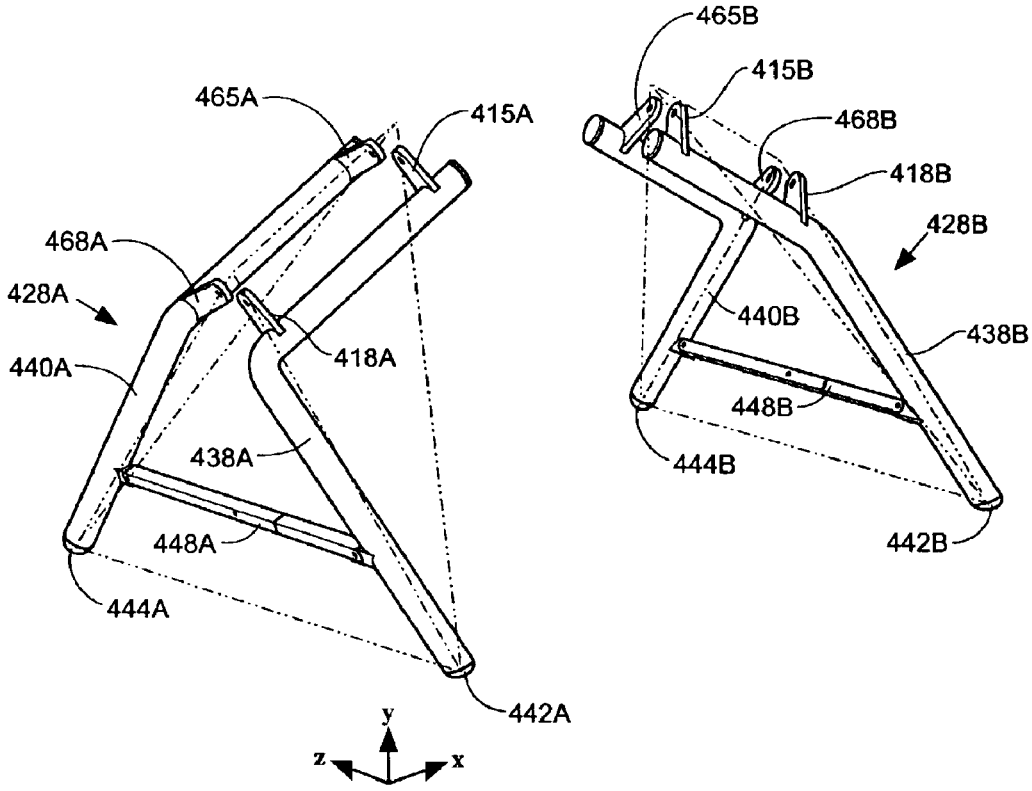
FIG. 25 is a perspective view of the self-stabilizing of FIG. 24, with the crossbeam removed to show additional detail.

The trestle 410 is generally comprised of a substantially horizontal crossbeam 412 that is supported by first and second leg assemblies 428A, 428B. The crossbeam 412 has a web portion 420 and an upper rail 413, which defines a substantially horizontal support surface. As best shown in FIGS. 24 and 25, the web portion 420 of the crossbeam 412 is a plate that has parallel upper and lower base edges 422, 424. The upper rail 413 is secured to the web portion 420 along the upper base edge 422.

In this preferred embodiment, the first leg assembly 428A consists of a tubular leg 438A, which is bent near a midpoint thereof, and a tubular leg 440A, which is also bent near a midpoint thereof. Attached to the upper portion of the leg 438A is a hinge knuckle 415A and a hinge knuckle 418A. Similarly, attached to the upper portion of the leg 440A is a hinge knuckle 465A and a hinge knuckle 468A. The legs 438A, 440A also have low-friction feet 442A, 444A. Geometrically, the hinge knuckle 415A, the hinge knuckle 418A, and foot the 442A essentially form a triangular plane. Similarly, the hinge knuckle 465A, the hinge knuckle 468A, and the foot 444A essentially form another triangular plane.

The second leg assembly 428B consists of a tubular leg 438B, which is bent near a midpoint thereof, and a tubular leg 440B, which is also bent near a midpoint thereof. Attached to the upper portion of the leg 438B is a hinge knuckle 415B and a hinge knuckle 418B. Similarly, attached to the upper portion of the leg 440B is a hinge knuckle 465B and a hinge knuckle 468B. The legs 438B, 440B also have low-friction feet 442B, 444B. Geometrically, the hinge knuckle 415B, the hinge knuckle 418B, and the foot 442B essentially form a triangular plane. Similarly, the hinge knuckle 465B, the hinge knuckle 468B, and the foot 444B essentially form a triangular plane.

Figure 26:
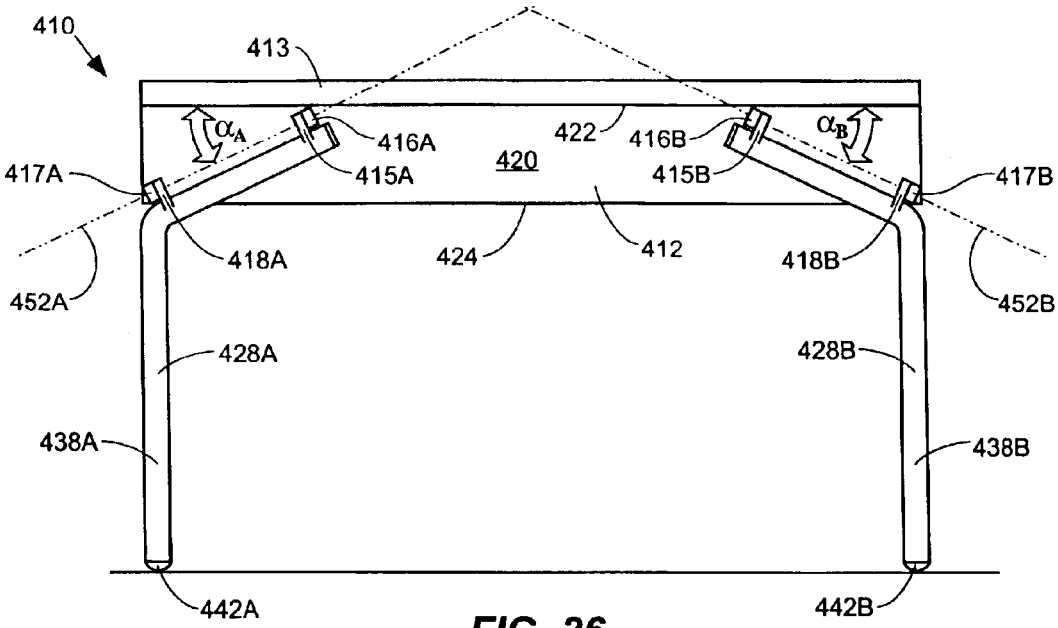
FIG. 26 is a side view of the self-stabilizing trestle of FIG. 24.
Figure 27:
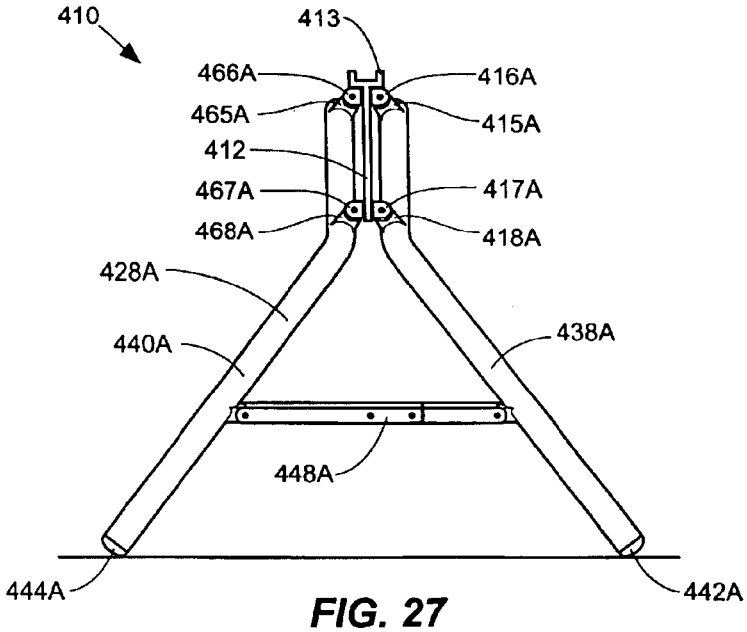
FIG. 27 is an end view of the self-stabilizing trestle of FIG. 24.

The leg assembly 428A is pivotally secured to the crossbeam 412 using the hinge knuckles 416A, 466A that are secured near the upper base edge 422 on each side of the web 420 and the hinge knuckles 417A, 467A that are secured near the lower base edge 424 on each side of the web 420. Thus, as shown in FIGS. 24, 26 and 27, the first leg assembly 428A is operably and pivotally connected to the crossbeam 412 by passing a hinge pin (not shown) through the upper hinge knuckles 415A, 416A; a hinge pin (not shown) through the upper hinge knuckles 465A, 466A; a hinge pin (not shown) through the lower hinge knuckles 417A, 418A; and a hinge pin (not shown) through the lower hinge knuckles 467A, 468A. The hinge pins that connect the leg 438A of the leg assembly 428A to the crossbeam 412 through the hinge knuckles 415A, 416A, 417A, and 418A define a common axis of rotation 452A that, similar to the embodiment illustrated in FIG. 9, is oriented at a predetermined acute angle $\alpha_A$ relative to the support surface defined by the crossbeam 412. The hinge pins that connect the leg 440A of the leg assembly 428A to the crossbeam 412 through the hinge knuckles 465A, 466A, 367A, and 468A also define a common axis of rotation 451A that, similar to the embodiment illustrated in FIG. 9, is oriented at a predetermined acute angle $\alpha_A$ relative to the support surface defined by the crossbeam 412. The importance of selecting an appropriate orientation angle $\alpha_A$ for these rotation axes 452A, 451A has been explained above.

The second leg assembly 428B is operably and pivotally connected to the crossbeam 412 by passing a hinge pin (not shown) through the upper hinge knuckles 415B, 416B; a hinge pin (not shown) through the upper hinge knuckles 465B, 466B; a hinge pin (not shown) through the lower hinge knuckles 417B, 418B; and a hinge pin (not shown) through the lower hinge knuckles 467B, 468B. The hinge pins that connect the leg 438B of the leg assembly 428B to the crossbeam 412 through the hinge knuckles 415B, 416B, 417B, and 418B define a common axis of rotation 452B that, similar to the embodiment illustrated in FIG. 9, is oriented at a predetermined acute angle $\alpha_B$ relative to the support surface defined by the crossbeam 412. The hinge pins that connect the leg 440B of the leg assembly 428B to the crossbeam 412 through the hinge knuckles 465B, 466B, 367B, and 468B also define a common axis of rotation 451B that, similar to the embodiment illustrated in FIG. 9, is oriented at a predetermined acute angle $\alpha_B$ relative to the support surface defined by the crossbeam 412. The importance of selecting an appropriate orientation angle $\alpha_B$ for these rotation axes 452B, 451B has been explained above.

The two rotation axes 452A, 452B are preferably substantiality coplanar, but not coaxial. The two rotation axes 452A, 452B intersect one another above the lower edge 424 of the crossbeam 412. In addition, the longitudinal axis of the crossbeam 412 (the lower base edge 424) and the two rotation axes 452A, 452B are essentially coplanar and effectively define a triangle, pointing upward. Similarly, the two rotation axes 451A, 451B are preferably substantiality coplanar, but not coaxial. The two rotation axes 451A, 451B also intersect one another above the lower edge 424 of the crossbeam 412. In addition, the longitudinal axis of the crossbeam 412 (the lower base edge 424) and the two rotation axes 451A, 451B are essentially coplanar and effectively define a triangle, pointing upward.

The feet 442A, 444A, 442B, 444B are the components of the leg assemblies 428A, 428B that actually contact the underlying terrain. The front and rear feet 442A, 444A, 442B, 444B of each leg assembly 428A, 428B are spaced apart from one another across the bisecting plane defined by the web portion 420 of the crossbeam 412.

Similar to the third and fourth preferred embodiments 210, 310 (FIGS. 15–23) the trestle 410 has leg assemblies 428A, 428B that can be folded in, and therefore require spreader braces 448A, 448B that withstand both tension and compression forces. The spreader brace 448A, similar to the one illustrated in FIG. 18, is pivotally secured between the legs 438A and 440A, and ensures that a fixed distance is maintained between the feet 442A, 444A of the first leg assembly 428A. The hinge axes 477A, 478A at which the spreader brace 448A is attached to the legs 438A, 439A are substantially parallel to the rotation axes 451A, 452A. The spreader brace 448B, also similar to the one illustrated in FIG. 18, is pivotally secured between the legs 438B, 440B, and ensures that a fixed distance is maintained between the feet 442B, 444B of the first leg assembly 428B. The hinge axes 477B, 478B at which the spreader brace 448B is attached to legs 438B, 440B are substantially parallel to the rotation axes 451B, 452B. Note that, although it is preferred that the respective rotation axes 451, 452 on each end of the crossbeam 412 are parallel, it is not essential for self-stabilization. It is preferred that the axes 451, 452 are parallel to avoid undue strain on the hinges of the spreader braces 448A, 448B. If the rotation axes 451, 452 are not parallel to one another, the hinge 274, as shown in FIG. 18, should have significant tolerance (play) or be a ball joint.

This preferred construction of the trestle 410, specifically the attachment of the leg assemblies 428A, 428B relative to the crossbeam 412, provides the trestle 410 with desired rotational stability of the crossbeam 412, using the same principle as illustrated in FIG. 7. With each of the four feet 442A, 444A, 442B, 444B of the trestle 410 resting firmly on the underlying terrain, the orientation of the crossbeam 412 of trestle 410 is essentially locked, preventing the crossbeam 412 from rotating in either direction about an axis longitudinal to the crossbeam 412, as illustrated in FIG. 7.

As best shown in FIG. 25, the leg assembly 428A has a generally tetrahedral structure. The hinge knuckles 415A, 418A, 465A, and 468A lie at the upper edges of this tetrahedral structure, and the feet 442A and 444A form two vertices at the bottom. Similarly, the leg assembly 428B has a generally tetrahedral structure. The hinge knuckles 415B, 418B, 465B, and 468B lie at the upper edges of this tetrahedral structure, and the feet 442B and 444B form two vertices at the bottom.

In operation, the leg assemblies 428 of the trestle 410, having rotation axes that intersect above the crossbeam 412, behave in the same manner as the leg assemblies 28, 128, 228, and 329 of the trestles 10, 110, 210, and 310, all having rotation axes that intersect below the crossbeam. The slippage ratio, the friction factor, and the friction counterforce are the same regardless of whether this intersection is above or below the crossbeam (i.e., whether the triangle defined by the rotation axes is pointing up or down.) In other words, for purposes of the mathematical calculations, the location of the intersection is irrelevant, provided that the acute axis orientation angle ($\alpha=\alpha_A=\alpha_B$) is the same. Given these characteristics, with the intersection of the rotation axes 451, 452 above the crossbeam, the trestle 410 achieves its self-stabilizing purpose using essentially the same operating principle and parameters as if the intersection of the rotation axes 451, 452 is below the crossbeam.

It will be obvious to those skilled in the art that other modifications may be made to the invention as described herein without departing from the spirit and scope of the present invention.

What is claimed is:

1. A self-stabilizing trestle that provides a stable, substantially horizontal support surface when placed on uneven terrain, comprising:

a crossbeam having a first end and a second end, and defining the substantially horizontal support surface;

a first leg assembly disposed near the first end of said crossbeam and secured to said crossbeam for pivoting about a first hinge defining a first rotation axis that is oriented at a predetermined acute angle relative to the support surface defined by said crossbeam; and a second leg assembly disposed near the second end of said crossbeam and secured to said crossbeam for pivoting about a second hinge defining a second rotation axis that is oriented at a predetermined acute angle relative to the support surface defined by said crossbeam;

wherein said first and second leg assemblies each have a generally tetrahedral structure including three lateral faces joined along three lateral edges, said first hinge being secured to said first leg assembly along one of its lateral edges, and said second hinge being secured to said second leg assembly alone one of its lateral edges:

wherein said first and second hinges allow for independent pivoting of the first and second leg assemblies about said first and second rotation axes and relative to said crossbeam, thereby allowing the support surface defined by said crossbeam to be maintained at a substantially horizontal orientation when said first and second leg assemblies are placed on uneven terrain.

2. The self-stabilizing trestle as recited in claim 1, wherein the predetermined acute angle associated with the orientation of said first rotation axis is substantially equal to the predetermined acute angle associated with the orientation of said second rotation axis.

3. The self-stabilizing trestle as recited in claim 1, wherein said first and second leg assemblies each include a pair of feet that firmly contact the terrain upon which said trestle is positioned.

4. The self-stabilizing trestle as recited in claim 3, wherein said first leg and second assemblies each include a spreader brace for resisting both compression and tension, such that, when the self-stabilizing trestle is placed for use, the distance between the respective feet of each leg assembly remains substantially constant.

5. The self-stabilizing trestle as recited in claim 3, wherein each foot is equipped with an independently rotating wheel.

6. The self-stabilizing trestle as recited in claim 5, wherein the predetermined acute angles associated with the orientation of each rotation axis are less than approximately 80 degrees.

7. The self-stabilizing trestle as recited in claim 1, wherein said crossbeam comprises an upper flange that defines said horizontal support surface and a lower web portion that operably connects said upper flange to said first and second leg assemblies.

8. The self-stabilizing trestle as recited in claim 7, wherein the lower web portion of said crossbeam is a substantially trapezoidal plate having parallel upper and lower base edges and first and second side edges, the upper planar member of said crossbeam being secured to the upper base edge of said plate, and the fist and second leg assemblies of said trestle being pivotally connected to the plate along said first and second side edges by said first and second hinges.

9. The self-stabilizing trestle as recited in claim 1, wherein the predetermined acute angles associated with the orientation of each rotation axis are less than approximately 44 degrees.

10. A self stabilizing trestle that provides a stable, substantially horizontal support surface when placed on uneven terrain, comprising:

a crossbeam having a first end and a second end, and defining the substantially horizontal support surface;

a first leg assembly disposed near the first end of said crossbeam and secured to said crossbeam for pivoting about a first hinge arrangement that is oriented at a predetermined acute angle relative to the support surface defined by said crossbeam; and a second leg assembly disposed near the second end of said crossbeam and secured to said crossbeam for pivoting about a second hinge arrangement that is oriented at a predetermined acute angle relative to the support surface defined by said crossbeam;

wherein said first hinge arrangement comprises a pair of hinges positioned on either side of said crossbeam for rotation about a first set of substantially parallel rotation axes, and said second hinge arrangement comprises another pair of hinges positioned on either side of said crossbeam for rotation about a second set of substantially parallel rotation axes; and wherein said first and second hinge arrangements allow for independent pivoting of the first and second leg assemblies about said first and second sets of rotation axes and relative to said crossbeam, thereby allowing the support surface defined by said crossbeam to be maintained at a substantially horizontal orientation when said first and second leg assemblies are placed on uneven terrain.

11. A self-stabilizing trestle that provides a stable, substantially horizontal support surface when placed on uneven terrain, comprising:

a crossbeam having a first end and a second end and defining the substantially horizontal support surface;

a first leg assembly disposed near the first end of said crossbeam and secured to said crossbeam by a first set of coaxial hinges, said first set of coaxial hinges defining a first rotation axis that is oriented at a predetermined acute angle relative to the support surface defined by said crossbeam; and a second leg assembly disposed near the second end of said crossbeam and secured to said crossbeam by a second set of coaxial hinges, said second set of coaxial hinges defining a second rotation axis that is oriented at a predetermined acute angle relative to the support surface defined by said crossbeam; and wherein said first and second sets of coaxial hinges allow for independent pivoting of the first and second leg assemblies relative to said crossbeam, thereby allowing the support surface defined by said crossbeam to be maintained at a substantially horizontal orientation when said leg assemblies are placed on uneven terrain.

12. The self-stabilizing trestle as recited in claim 11, wherein the predetermined acute angle associated with the orientation of said first rotation axis is substantially equal to the predetermined acute angle associated with the orientation of said second rotation axis.

13. A self-stabilizing trestle for maintaining a stable work surface at a substantially horizontal orientation over an uneven terrain, comprising:

a crossbeam extending substantially the length of said trestle and supporting the work surface, said crossbeam having a pair of ends; and first and second leg assemblies each positioned adjacent a respective crossbeam end, each of said leg assemblies being pivotally connected to said crossbeam so as to independently pivot along respective first and second pivot axes, said first and second pivot axes downwardly converging toward one another and being essentially coplanar in a substantially vertically disposed plane bisecting said trestle, each of said leg assemblies downwardly extending from said respective first and second pivot axes and terminating in at legst two support feet spaced from one another across said bisecting plane.

14. A self-stabilizing trestle that provides a stable, substantially horizontal support surface when placed on uneven terrain, comprising:

a crossbeam having a first end and a second end and defining the substantially horizontal support surface, a first hinge being secured to said first end of the crossbeam and defining a first rotation axis, a second hinge being secured to said second end of the crossbeam and defining a second rotation axis, wherein said first and second rotation axes intersect below said support surface, and wherein said horizontal support surface, said first rotation axis, and said second rotation axis form a triangle;

a first leg assembly secured to said crossbeam by said first hinge between first and second endpoints of said first hinge for pivoting about said first rotation axis, said first leg assembly having first and second feet for contacting the terrain upon which said trestle is placed, wherein the first endpoint of said first hinge, the second endpoint of said first hinge and said first foot form a triangle, and wherein the first endpoint of said first hinge, the second endpoint of said first hinge and said second foot form a triangle; and a second leg assembly secured to said crossbeam by said second hinge between first and second endpoints of said second hinge for pivoting about said second rotation axis, and said second leg assembly having third and fourth feet for contacting the terrain upon which said trestle is placed, wherein the first endpoint of said second hinge, the second endpoint of said second hinge and said third foot form a triangle, and wherein the first endpoint of said second hinge, the second endpoint of said second hinge and said fourth foot form a triangle;

wherein said first and second hinges allow for independent pivoting of said first and second leg assemblies and relative to said crossbeam, thereby allowing the support surface defined by said crossbeam to be maintained at a substantially horizontal orientation when said first and second leg assemblies are placed on uneven terrain.

15. A self-stabilizing trestle that provides a stable, substantially horizontal support surface when placed on uneven terrain, comprising:

a crossbeam defining the substantially horizontal support surface, having a first hinge arrangement on one side and a second hinge arrangement on the opposite side;

a first leg assembly, having a first foot and a second foot, and secured at said first hinge arrangement to said crossbeam for pivoting about a first hinge axis; and a second leg assembly, having a third foot and a fourth foot, and secured to said crossbeam at said second hinge arrangement for pivoting about a second hinge axis;

wherein said first hinge axis has a first hinge endpoint and a second hinge endpoint lying in a first plane;

wherein said second hinge axis has a third hinge endpoint and a fourth hinge endpoint lying in a second plane;

wherein said first plane and said second plane intersect below said horizontal support surface;

wherein said first leg assembly has a generally tetrahedral structure with four vertices, and wherein said first hinge endpoint is a vertex, said second hinge endpoint is a vertex, said first foot is a vertex, and said second foot is a vertex;

wherein said second leg assembly has a generally tetrahedral structure with four vertices, and wherein said third hinge endpoint is a vertex, said fourth hinge endpoint is a vertex, said third foot is a vertex, and said fourth foot is a vertex; and wherein said first leg assembly and said second leg assembly can pivot independently relative to said crossbeam and independently relative to one another, thereby allowing the support surface defined by said crossbeam to be maintained at a substantially horizontal orientation when said first and second leg assemblies are placed on uneven terrain.

16. The self-stabilizing trestle as recited in claim 15, wherein said first hinge axis is oriented at a predetermined acute angle relative to the support surface defined by said crossbeam, and said second hinge axis is also oriented at a predetermined acute angle relative to the support surface defined by said crossbeam.

17. The self-stabilizing trestle as recited in claim 16, wherein the predetermined acute angles associated with the orientation of each hinge axis are less than approximately 44 degrees.

18. The self-stabilizing trestle as recited in claim 16, wherein each foot is equipped with an independently rotating wheel.

19. The self-stabilizing trestle as recited in claim 18, wherein the predetermined acute angles associated with the orientation of each hinge axis are less than approximately 80 degrees.

20. The self-stabilizing trestle as recited in claim 15, wherein said first leg and second assemblies each include a spreader brace for resisting both compression and tension, such that, when the self-stabilizing trestle is placed for use, the distance between the respective feet of each leg assembly remains substantially constant.

21. The self-stabilizing trestle as recited in claim 15, wherein said first hinge arrangement comprises a pair of hinges positioned on either side of said crossbeam for rotation about a first set of substantially parallel rotation axes, and said second hinge arrangement comprises another pair of hinges positioned on either side of said crossbeam for rotation about a second set of substantially parallel rotation axes.

22. A self-stabilizing trestle that provides a stable, substantially horizontal support surface when placed on uneven terrain, comprising:

a crossbeam having a first end and a second end, and defining the substantially horizontal support surface;

a first leg assembly disposed near the first end of said crossbeam and secured to said crossbeam for pivoting about a first hinge arrangement, said first leg assembly having a pair of feet for contacting the uneven terrain, the distance between the respective feet being fixed while in use; and a second leg assembly disposed near the second end of said crossbeam and secured to said crossbeam for pivoting about a second hinge arrangement, said second leg assembly having a pair of feet for contacting the underlying terrain, the distance between the respective feet being fixed while in use;

wherein, the feet of one of said leg assemblies move in a substantially vertical direction due to the placement of said trestle on the uneven terrain resulting in measurable vertical feet displacements, the feet of said one leg assembly slip across the uneven terrain in a substantially horizontal feet direction resulting in measurable horizontal displacements, thereby ensuring that the support surface defined by said crossbeam is maintained at a substantially horizontal orientation.

23. The self-stabilizing trestle as recited in claim 22, wherein said first hinge arrangement defines a first rotation axis that is oriented at a predetermined acute angle relative to the support surface defined by said crossbeam and said second hinge arrangement defines a second rotation axis that is oriented at a predetermined acute angle relative to the support surface defined by said crossbeam;

wherein a slippage ratio is defined as a sum of the horizontal displacements of both of said pair of feet across said uneven terrain divided by a sum of the vertical displacements of both of said pair of feet as one of said leg assemblies rotates; and wherein the slippage ratio is substantially equal to the tangent of the predetermined acute angle at which the rotation axis of the rotating leg assembly is oriented relative to the support surface defined by said crossbeam.

* * * * *

UNITED STATES PATENT AND TRADEMARK OFFICE

CERTIFICATE OF CORRECTION

PATENT NO. : 6,892,859 B2
DATED : May 17, 2005
INVENTOR(S) : Paul van der Pol

It is certified that error appears in the above-identified patent and that said Letters Patent is hereby corrected as shown below:

Column 22,
Line 17, change the word “alone” to -- along --

Column 24,
Line 3, change the word “legst” to -- least --

Signed and Sealed this

Ninth Day of August, 2005

JON W. DUDAS
*Director of the United States Patent and Trademark Office*